US008604979B2

(12) United States Patent
Ge et al.

(10) Patent No.: US 8,604,979 B2
(45) **Date of Patent: *Dec. 10, 2013**

(54) BROAD BAND ANTENNA

(75) Inventors: JunXiang Ge, Tokyo (JP); Wasuke Yanagisawa, Tokyo (JP); Ryo Horie, Tokyo (JP)

(73) Assignee: Yokowo Co., Ltd., Tokyo (JP)

( * ) Notice: Subject to any disclaimer, the term of this patent is extended or adjusted under 35 U.S.C. 154(b) by 945 days.

This patent is subject to a terminal disclaimer.

(21) Appl. No.: 11/997,696

(22) PCT Filed: Aug. 3, 2006

(86) PCT No.: PCT/JP2006/315788
§ 371 (c)(1),
(2), (4) Date: May 7, 2010

(87) PCT Pub. No.: WO2007/015583
PCT Pub. Date: Feb. 8, 2007

(65) Prior Publication Data

US 2010/0220023 A1 Sep. 2, 2010

(30) Foreign Application Priority Data

Aug. 4, 2005 (JP) ..... 2005-227154

(51) Int. Cl.
*H01Q 1/38* (2006.01)
*H01Q 13/00* (2006.01)

(52) U.S. Cl.
USPC ..... 343/700 MS; 343/772; 343/846

(58) Field of Classification Search
None
See application file for complete search history.

(56) References Cited

U.S. PATENT DOCUMENTS

| | | | | |
|---|---|---|---|---|
| 2,944,258 | A * | 7/1960 | Yearout et al. | 343/767 |
| 3,031,665 | A * | 4/1962 | Robert-Pierre Marie | 343/770 |
| 4,760,400 | A * | 7/1988 | Lait | 343/700 MS |
| 4,843,403 | A * | 6/1989 | Lalezari et al. | 343/767 |
| 5,146,232 | A * | 9/1992 | Nishikawa et al. | 343/713 |
| 5,459,471 | A * | 10/1995 | Thomas | 342/175 |
| 6,313,798 | B1 * | 11/2001 | Bancroft et al. | 343/700 MS |
| 6,970,139 | B1 * | 11/2005 | Chew et al. | 343/767 |
| 7,324,049 | B2 * | 1/2008 | Myoung et al. | 343/700 MS |
| 8,068,064 | B2 * | 11/2011 | Yanagisawa et al. | 343/772 |
| 2004/0100409 | A1 * | 5/2004 | Okado | 343/700 MS |
| 2004/0169609 | A1 * | 9/2004 | Song et al. | 343/767 |
| 2004/0233109 | A1 * | 11/2004 | Ying et al. | 343/700 MS |
| 2005/0168383 | A1 * | 8/2005 | Lee | 343/700 MS |
| 2006/0071858 | A1 * | 4/2006 | Suh | 343/700 MS |
| 2006/0170593 | A1 * | 8/2006 | Watts | 343/700 MS |

FOREIGN PATENT DOCUMENTS

| | | |
|---|---|---|
| JP | 56-37702 | 4/1981 |
| JP | 1-295503 | 11/1989 |

(Continued)

OTHER PUBLICATIONS

International Search Report Dated Sep. 12, 2006.

*Primary Examiner* — Trinh Dinh
(74) *Attorney, Agent, or Firm* — Bachman & LaPointe, P.C.

(57) ABSTRACT

Provided is a wide band antenna having ultra-wide band and high performance at a low cost. An antenna element constituting a part of an opening cross section structure of a double cylinder ridge waveguide is spread on a plane. The antenna element has a ridge element portion (21) for adjusting antenna characteristic corresponding to a ridge portion and a radiation element portion (22) for electromagnetic wave radiation. Substantially at a leading end portion of the ridge element portion (21), a feeder terminal (24) is formed. Ground portions (23*a* and 23*b*) are maintained at a ground potential and the feeder terminal (24) is guided to an outside as a coplanar waveguide.

13 Claims, 30 Drawing Sheets

(56) References Cited

FOREIGN PATENT DOCUMENTS

| | | |
|---|---|---|
| JP | 2-29006 | 1/1990 |
| JP | 9-51223 | 2/1997 |
| JP | 9-246849 | 9/1997 |
| JP | 2000-278028 | 10/2000 |
| JP | 2001-284954 | 10/2001 |
| JP | 2001-320225 | 11/2001 |

* cited by examiner (a)

(b)

(a)

(b)

BROAD BAND ANTENNA

CROSS-REFERENCE TO RELATED APPLICATIONS

This application is a 371 of PCT/JP2006/315788 filed Aug. 3, 2006, which claims priority under 35 U.S.C. 119 from JAPAN 2005-227154 filed on Aug. 4, 2005, the contents of which are incorporated herein by reference.

TECHNICAL FIELD

The present invention relates to an antenna for a wide band communication system such as an ultra wide band (UWB) and a radio local area network (LAN), and more particularly, to a wide band antenna suitable as an antenna for a mobile terminal.

BACKGROUND ART

In recent years, a wide band communication system in which a UWB is applied and a radio LAN have been applied in diverse fields. For example, mobile terminals such as a personal computer (hereinafter, referred to as "PC") having a communication function owing to the UWB or the radio LAN, a cellular phone, and a personal digital assistance (PDA) have arrived.

Because various band frequencies are used in the UWB, the UWB antenna having a band as wide as possible is desired. In particular, an antenna to be incorporated into the mobile terminal is desirably high in performance and wide in band while being small in size and low in costs.

The conventional mobile terminal antenna had problems inherent therein such as its installation portion and a size of a ground conductor, that is, a ground portion. There are various kinds of mobile terminals such as a PC, a cellular phone, and a PDA. The configuration of a package differs according to a maker or a model even if the category is identical. The design or the like is usually changed every time a new function is added thereto even if the model is identical. Since the conventional wide band antenna (broad band antenna) is configured by the ground portion and an emission element portion in cooperation, there arise such problems that it is impossible to realize the wide band property, the antenna performance is remarkably changed with a change in installation portion of the antenna or a difference in the size of the ground portion.

An object of the present invention is to provide a wide band antenna capable of maintaining the wide band property without being affected by the change in the installation portion of the antenna or the size of the ground portion.

DISCLOSURE OF THE INVENTION

According to the present invention, a wide band antenna has a ridge element portion for adjustment of an antenna characteristic, which forms a part or all of the opening cross section structure of a ridge waveguide and develops on a plane, and a radiation element portion for electromagnetic wave radiation. The radiation element portion extends from the ridge element portion. The ridge element portion has an adjustment portion corresponding to the ridge portion of the ridge waveguide, and a feeder portion that is subjected to feeding. An antenna element and a ground conductor pattern can be integrated together on one printed circuit board.

Also, the wide band antenna may further include a capacitive coupling radiation element for electromagnetic wave radiation which is capacitively coupled with the radiation element portion or the ridge element portion. In this case, the radiation element portion is in a size that can be used at a first frequency band, and the capacitive coupling radiation element is in a size that can be used at a second frequency band that is lower in the band than the first frequency band.

Further, the wide band antenna may be configured such that the capacitive coupling radiation element portion is formed in a pattern same as that of the radiation element or a symmetric pattern.

As an electromagnetic wave that passes through the ridge waveguide, there are a TE mode wave and a TM mode wave. A surge impedance Zw of the TE mode wave and an impedance Ze of the TM mode wave, respectively, become as follows.

$$Zw=Zo/(1-(fc/f)^2)$$

$$Ze=Zo\cdot(1-(fc/f)^2)$$

In this case, $Zo=120\pi\cdot(\mu r/\epsilon r)$, with $\mu r$ being a relative permeability of a propagation medium and $\epsilon r$ being a relative permittivity of the propagation medium. In the case of a free space, $\mu r=\epsilon r=1$ and Zo becomes $120\pi$. When a frequency f of a signal is higher than a cutoff frequency fc of the waveguide, the signal passes through this ridge waveguide. When the frequency f of the signal is overwhelmingly higher than the cutoff frequency fc, values of Zw and Ze become $120\pi$ like Zo in a free space. A cutoff frequency fc of the ridge waveguide is lower than that of an ordinary rectangular waveguide having the same cross-section size, for instance. Therefore, it becomes possible to realize an antenna in which wide band property is maintained while lowering a usable frequency. Also, a surface portion that is similar to the ridge element portion is included, so a matching range is broadened as compared with a case where, for instance, a wire is wound. In other words, it also becomes possible to suppress a mismatch at a feeder terminal while achieving a function as an electromagnetic wave radiator. At the time of designing and production, it is sufficient that consideration is given only to the lowest frequency whose use is planned, which facilitates mass production and also realizes cost reduction. Accordingly, the wide band antenna according to the present invention operates in an operation mode, such as an operation mode of a high pass filter, in which when the cutoff frequency fc is determined, all frequencies f that are significantly higher than the cutoff frequency fc are passed.

The ridge waveguide may include, for example, a double cylinder ridge waveguide having a pair of ridge portions whose leading ends face each other. In this case, the ridge element portion corresponds to one ridge portion of the double cylinder ride waveguide, and an element portion corresponding to the other ridge portion of the double cylinder ridge waveguide includes a ground portion that is maintained to a ground potential.

The ground portion is connected directly with an external ground conductor. Since the ground portion is originally maintained to the ground potential, the ground portion is connected directly with the external ground conductor, to thereby suppress a variation in the used frequency. The configuration and size of the external ground conductor can be arbitrarily set. That is, it is possible to realize the antenna that is not affected by the installation portion.

A feeder wire that extends from the feeder terminal can be guided to an outside as a coplanar waveguide (CPW). With this configuration, an excellent high frequency characteristic can be maintained at a feeder point.

It is preferred that at least one of the ridge element portion and the ground portion be formed in arc or substantially arc.

Such a configuration increases the upper limit of the available frequency unboundedly as compared with the configurations having other than arc or substantially arc, thereby making it possible to provide a remarkable wide band property. The ridge element portion is integrated with the adjustment element portion for fine adjustment of the band from the viewpoint that excellently maintains the wide band property.

The ridge element portion may be, for example, of one base end structure which is obtained by cutting out the ridge portion of the ridge waveguide in the opening cross section structure in a height direction, in which the radiation element portion extends from the base end of the ridge element portion. Alternatively, the ridge element portion may be of a both base end structure that is symmetrical with respect to a portion where the height of the ridge portion of the ridge waveguide in the opening cross section structure is maximum as a center line, in which the radiation element portion extends from both base ends of the ridge element portion.

In the wide band antenna, when electricity from the feeder terminal is fed to a center portion of the ridge element portion, there occur multiple mode waves that are symmetric with the site as a center. In the case of the ridge waveguide, an electric field strength of a passing electromagnetic wave becomes the maximum at a center ($TE_{10}$) of the ridge portion, so even when the ridge element portion is given a one base end configuration, the characteristics themselves of a high pass filter do not differ from those in the case of a both base end configuration to be described later. It becomes possible to reduce a size thereof by a degree corresponding to the one base end configuration.

It should be noted that it does not matter which one of a construction, in which an odd number mode ($TE_{10}$, $TE_{30}$, $TE_{50}$) is used, and a construction, in which an even number mode ($TE_{20}$, $TE_{40}$, ••) is used, is selected but it is preferable that the construction, in which the odd number mode is used, be selected.

For the wide band property, there is the possibility that a difference occurs in a group delay time within the use frequency band. In order to improve this matter, in the wide band antenna according to the present invention, the radiation element portion is formed in a meander configuration of such a size that the group delay time at least in the use frequency band is maintained in a given range. The adjustment element portion for the fine band adjustment can be interposed between the ridge element portion and the radiation element portion.

The ridge element portion can be, for example, of one base end configuration in which the ridge portion of the ridge waveguide in the opening cross section structure is cut out in the height direction. In this case, the radiation element portion extends from the base end of the ridge element portion.

According to the present invention, there can be provided the wide band antenna having an ultra wide band property that the available lowest frequency is provided. As described above, it has been difficult to widen the band in the antenna having the ground portion. However, as in the present invention, with the provision of the opening structure of the ridge waveguide, the band can be widened.

BEST MODE FOR CARRYING OUT THE INVENTION

First Embodiment

Hereinafter, a description will be given of a mode example when the present invention is implemented as a UWB antenna of a wide band used in a UWB communication. In this example, there is shown an example in which the present invention is applied to a planar wide band antenna having an opening cross section structure of a double cylinder ridge waveguide.

Figure 1:
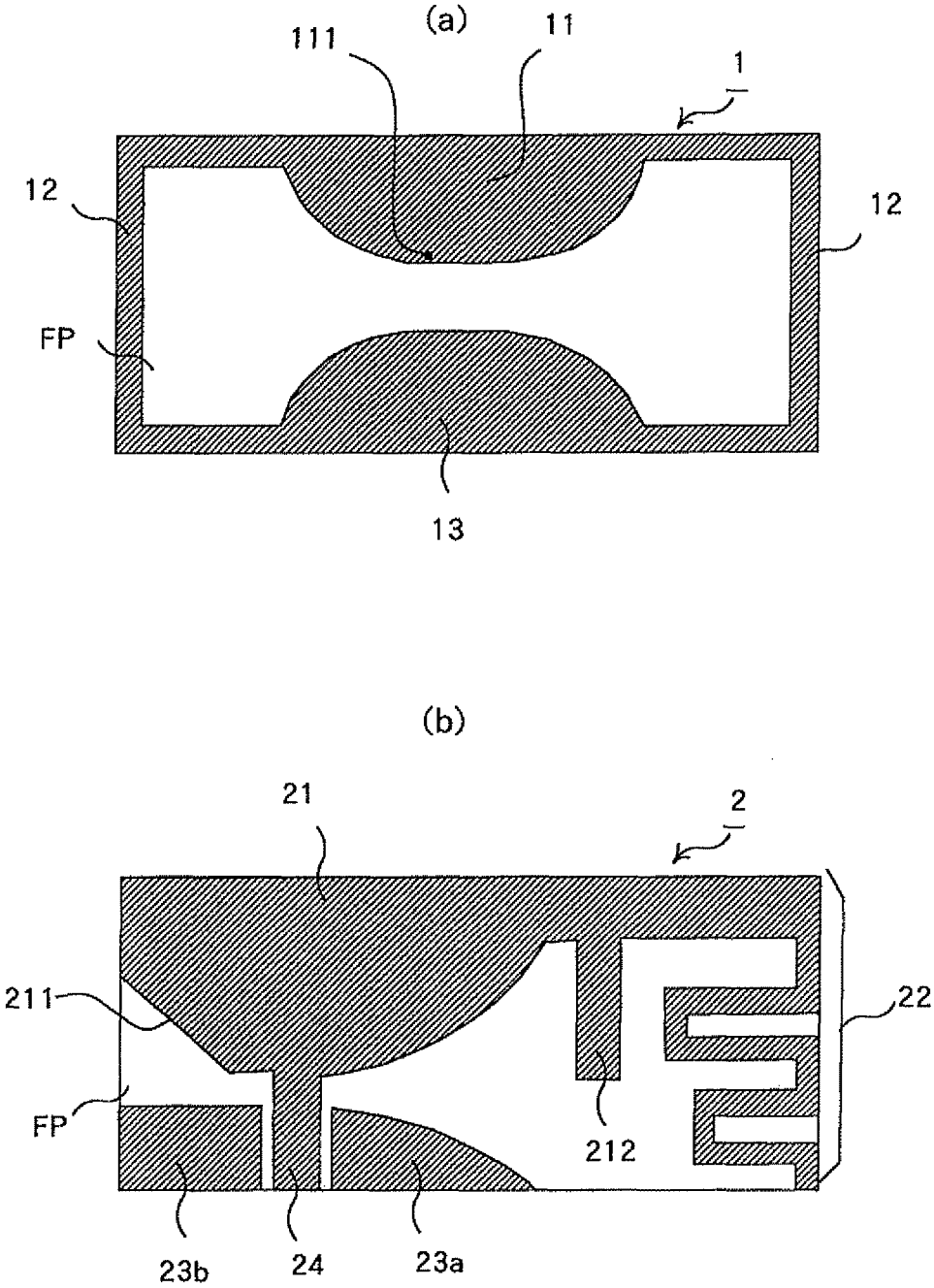
FIG. 1 are diagrams showing an antenna element of a wide band antenna according to a first embodiment of the present invention, in which part (a) is a basic pattern diagram, and part (b) is a pattern diagram of the CPW structure.

FIG. 1(*a*) shows a basic pattern of an antenna element included in a wide band antenna according to the present invention. A wide band antenna 1 is configured by provision of an antenna element having an opening cross section structure of the double cylinder ridge waveguide on a planar substrate FP that is made of, for example, resin. The antenna element is made of a metal that is high in conductivity, for example, copper.

The antenna element is structured by both base ends that are symmetrical about a portion that is highest in the height of the ridge portion of the ridge waveguide in the opening cross section structure as a center line. The antenna element has a ridge element portion 11, a radiation element portion 12, and a ground portion 13. The ridge element portion 11 and the ground portion 13 are molded in a substantially arc configuration.

The ridge element portion 11 is an element portion corresponding to one ridge portion of the double cylinder ridge waveguide. The ridge element portion 11 is used for facilitating the impedance matching, for example, over a wide frequency band. The radiation element portion 12 corresponds to a wall portion of the double cylinder ridge waveguide, and extends integrally from a pair of base end portions of the ridge element portion 11, respectively. The radiation element portion 12 is used for electromagnetic wave radiation. The ground portion 13 is an element portion corresponding to another ridge portion of the double cylinder ridge waveguide, and maintained to the ground potential. A feeder terminal 111 is formed substantially in the vicinity of a leading end portion of the ridge element portion 11. That is, a core wire of a coaxial cable that is connected to an external electronic circuit is joined to substantially the vicinity of the leading end portion of the ridge element portion 11.

The wide band antenna 1 configured as described above changes to substantially the same operation mode as that of the double cylinder ridge waveguide when electricity is fed to the feeder terminal 111 of the ridge element portion 11. For example, the electricity is fed through the ridge element portion 11 to make an impedance matching range broader than that in the case where a wire is winded. As a result, it is possible to suppress mismatching at the feeder terminal 111 over the wider frequency range. Also, the ground portion 13 operates as an impedance adjustment body and a ground conductor.

Accordingly, the wide band antenna 1 per se has a function of the ground, and radiates electromagnetic waves from the radiation element portion 12 while conducting the impedance matching over a wide range in the ridge element portion 11.

A frequency f of the electromagnetic wave that is radiated from the radiation element portion 12 comes to an operation mode such as a high pass filter that all of the frequency f that is remarkably higher than a cutoff frequency fc that is determined by the radiation element portion 12 pass therethrough as described above.

Since the ground portion 13 is maintained to the ground potential, the external conductor can be directly connected to the ground portion 13. The wide band antenna of the present invention reduces the influence of the ground on the radiation characteristic or the like, differently from the general antenna whose ground operates as the radiator, thereby making it possible to arbitrarily set the sizes of the external conductor. This relationship is schematically shown in FIG. 3.

Figure 3:
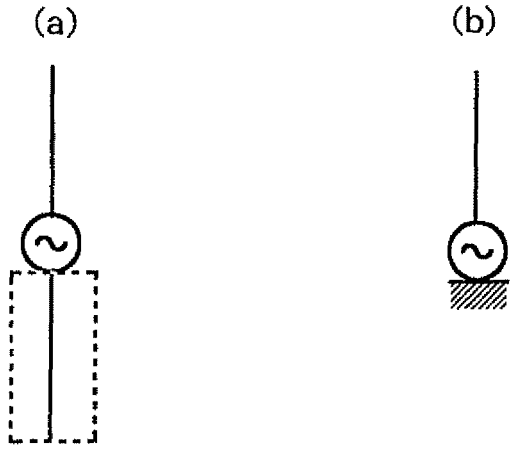
FIG. 3 are diagrams showing the structure of the antenna, in which part (a) is a diagram schematically showing a general antenna, and part (b) is a schematic diagram showing the wide band antenna according to the first embodiment.

FIG. 3(*a*) shows the general antenna in which a solid line that extends from the feeder point toward the upper portion indicates the radiation element, and a broken line indicates the ground. The radiation element and the ground function as the antenna. For the above reason, the excellent wide band property is not obtained in the antenna that connects the ground up to now. On the contrary, FIG. 3(*b*) is a wide band antenna of this embodiment. The radiation of the electromagnetic wave is conducted by only the radiation element. For that reason, it is possible to realize the wide band antenna having the flexible sizes of the outer conductor without being affected by the installation portion.

If only the lowest frequency intended to be used is taken into consideration at the time of designing and manufacturing, any frequencies that is equal to or higher than the lowest frequency can be used. Accordingly, when the design and manufacture are conducted by the sizes suited for the lowest use frequency, one antenna can be used as antennas for a large number of communications.

The antenna element can be modified in various configurations on the basis of the configuration of FIG. 1(*a*). For example, FIG. 1(*b*) shows an example of a planar wide band antenna 2 suitable for the use in the mobile terminal. The antenna element of the wide band antenna 2 includes a ridge element portion 21, a radiation element portion 22, ground portions 23*a* and 23*b*, and a feeder terminal (wire) 24.

The ridge element portion 21 is configured in such a manner that a portion corresponding to one ridge portion of the double cylinder ridge waveguide is cut at an eccentric position where the large amount of ridge portion remains from the center line in the height direction, and a part 211 of the sloped ridge portion is obliquely cut. The other ridge portion is formed with a patch body 212. In this embodiment, the patch body 212 and the part of the ridge portion which is obliquely cut form the adjustment element portion. The adjustment element portion is disposed in order to excellently maintain the group delay characteristic and the transmission waveform characteristic of the signal. In other words, since the wide band antenna according to the present invention can use the plural frequencies, there can occur a variation in delay time or transmission waveform characteristic according to the frequency. The adjustment element portion is provided to prevent the variation. The configuration of the adjustment element portion does not need to be configured as shown in FIG. 1(*b*), but can be arbitrarily set.

In order to enhance the radiation efficiency, the radiation element portion 22 is partially formed in a meander configuration. The ground portion has a CPW structure that guides the feeder terminal 24 that extends integrally from the substantially leading end of the ridge element portion 21 to the external as a coplanar waveguide. That is, the ground portion is constituted by a pair of waveguides 23*a* and 23*b* with the feeder terminal 24 on the same surface at a given gap. The application of the CPW structure enables the impedance mismatching at the feeder terminal to be suppressed.

Figure 2:
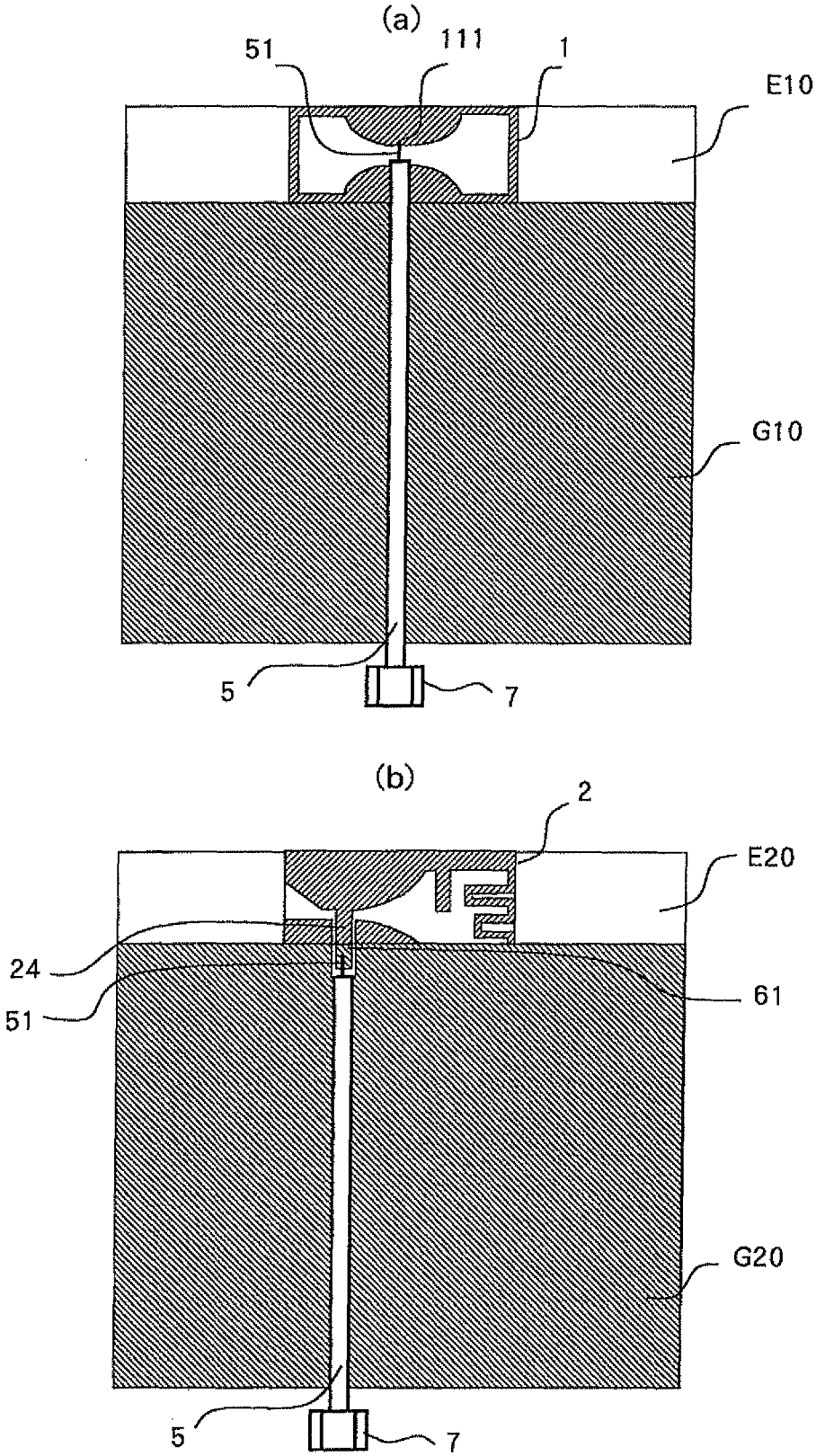
FIGS. 2(*a*) and 2(*b*) are front views showing an implementation state of the wide band antenna according to the first embodiment.

When the antenna shown in FIGS. 1(*a*) and 1(*b*) is implemented into a communication device, the antenna is structured as shown in FIGS. 2(*a*) and 2(*b*).

In FIG. 2(*a*), the planar wide band antenna 1 shown in FIG. 1(*a*) is fitted to a resin plate E10, and the ground portion 13 of the wide band antenna 1 is connected to an external ground conductor G10. The feeder terminal 111 of the wide band antenna 1 is connected with, for example, a core 5A that is exposed from one end of a semi rigid cable 5. The other end of the semi rigid cable 5 is fitted with a coaxial connector 7 for connection to an electronic circuit not shown.

In FIG. 2(*b*), the wide band antenna 2 shown in FIG. 1(*b*) is fitted to a resin plate E20, and the ground portions 23*a* and 23*b* of the wide band antenna 2 are connected with an external ground conductor G20. The feeder terminal 24 of the wide band antenna 2 is connected with the core 5A that is exposed from, for example, one end of the semi rigid cable 5 through a joint 61 that is disposed on the external ground conductor G20. The other end of the semi rigid cable 5 is fitted with the coaxial connector 7 for connection to the electronic circuit not shown.

The antenna pattern shown in FIGS. 1(*a*) and 1(*b*), the pattern of the joint 61, and the ground conductor pattern can be formed on one resin printed circuit board with metal films.

(Antenna Characteristics)

Subsequently, a description will be given in detail of the antenna characteristics of the wide band antenna 2 shown in FIG. 2(*b*).

Figure 4:
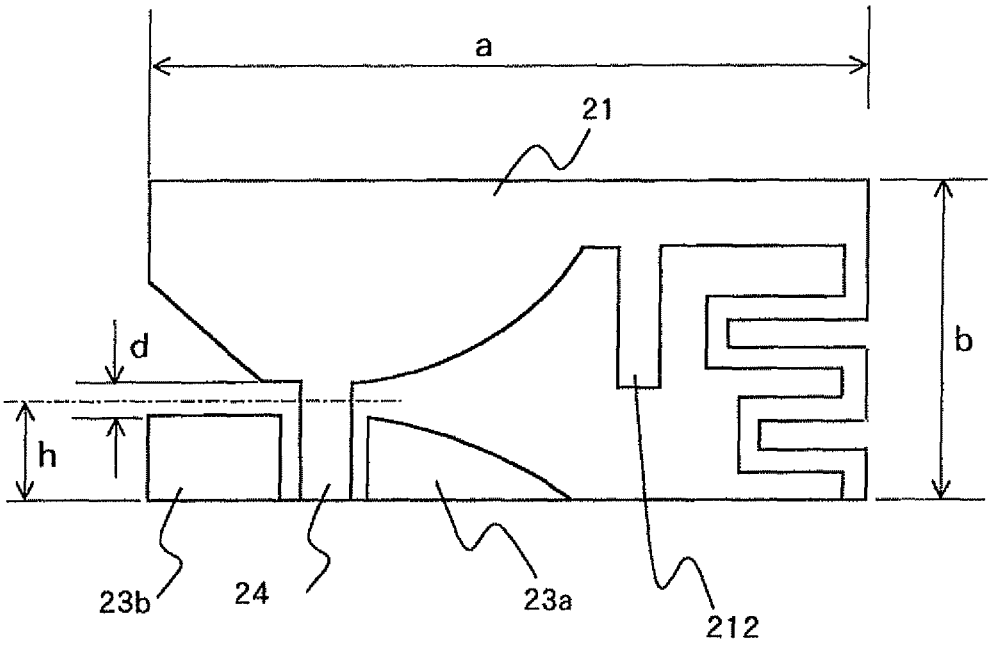
FIG. 4 is a diagram showing the sizes of the wide band antenna according to the first embodiment when the lowest frequency is set to 3.1 [GHz].

FIG. 4 represents the sizes of the wide band antenna 2 in the case where the use frequency band is equal to or higher than 3.1 [GHz]. For convenience of a measuring gauge, the upper limit of the use frequency band is set to 12 [GHz]. The sizes are 0.6 [mm] in the thickness of the entire antenna element, 30 [mm] in a length a between the ridge element portion 21 and a return portion of the radiation element portion 22, and 10 [mm] in a length b of the radiation element portion 22.

A gap d between the leading end of the ridge element portion 21 and the leading end portion of the ground portion 23*b* is changed, thereby making it possible to finely adjust the impedance. Also, a length h between the center of the gap d and the external ground conductor is changed, thereby making it possible to finely adjust the lowest frequency to be used. Reference d is about 1 [mm], and h is about 3 [mm].

In the wide band antenna 2 of the above sizes, the results of simulating the characteristics of the antenna having an ideal configuration without any error, which is designed by software on the basis of the Maxwell's electromagnetic theory and the antenna design theory, for example, on a computer, are indicated below. The simulation is conducted because the measuring gauge only supports up to about 12 [GHz] as of today. It is confirmed that the results of the simulation hardly differs from the actual measurements within a measured range.

Figure 5:
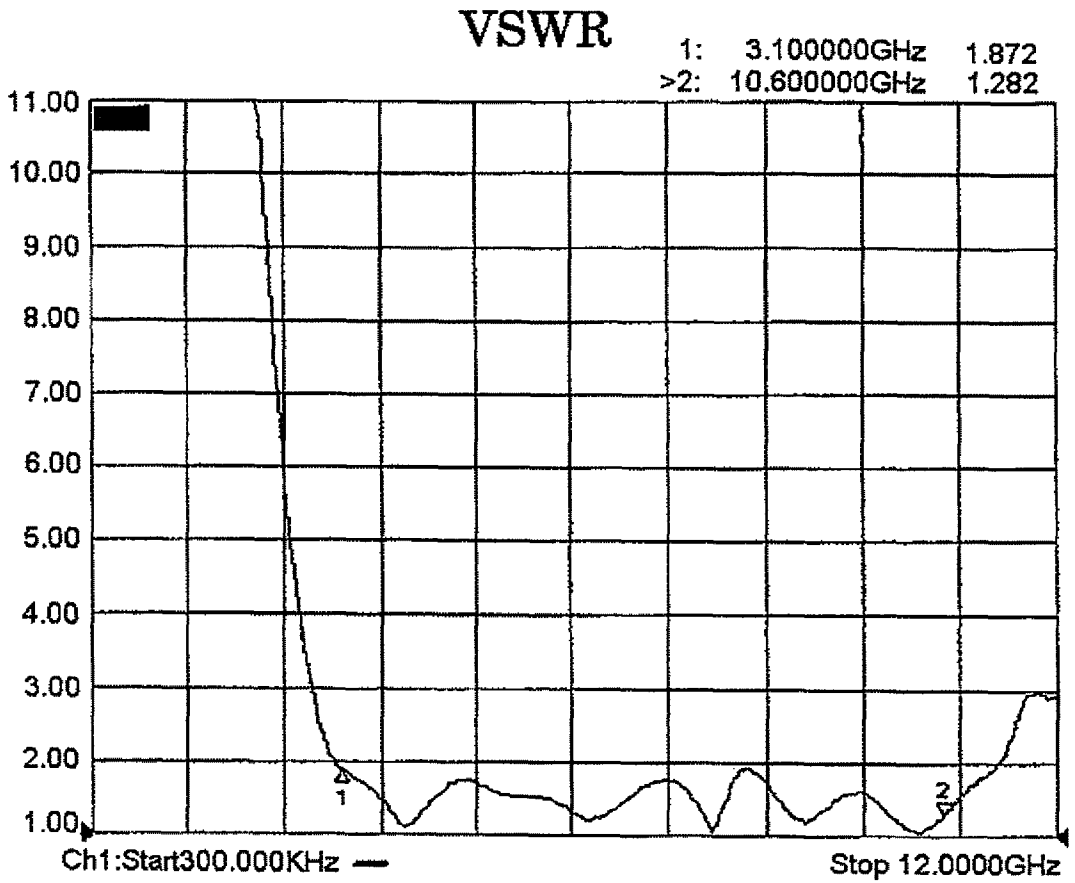
FIG. 5 is a VSWR characteristic diagram of the wide band antenna of the sizes shown in FIG. 4.

FIG. 5 is a VSWR characteristic diagram of the wide band antenna 2 of the above sizes. As is apparent from FIG. 5, when only the lowest frequency is determined by the above sizes, all of the VSWR of the frequency that is equal to or higher than the lowest frequency by a given value fall within the practical use range (2 or lower). For convenience of the measuring gauge, 12 [GHz] or higher is not quantified by a numeric value, but it is confirmed that the VSWR is excellently maintained even at the higher frequency that is 12 [GHz] or higher. The VSWR when the use frequency is 3.1 [GHz] is 1.872, and the VSWR when the use frequency is 10.6 [GHz] is 1.282.

Figure 6:
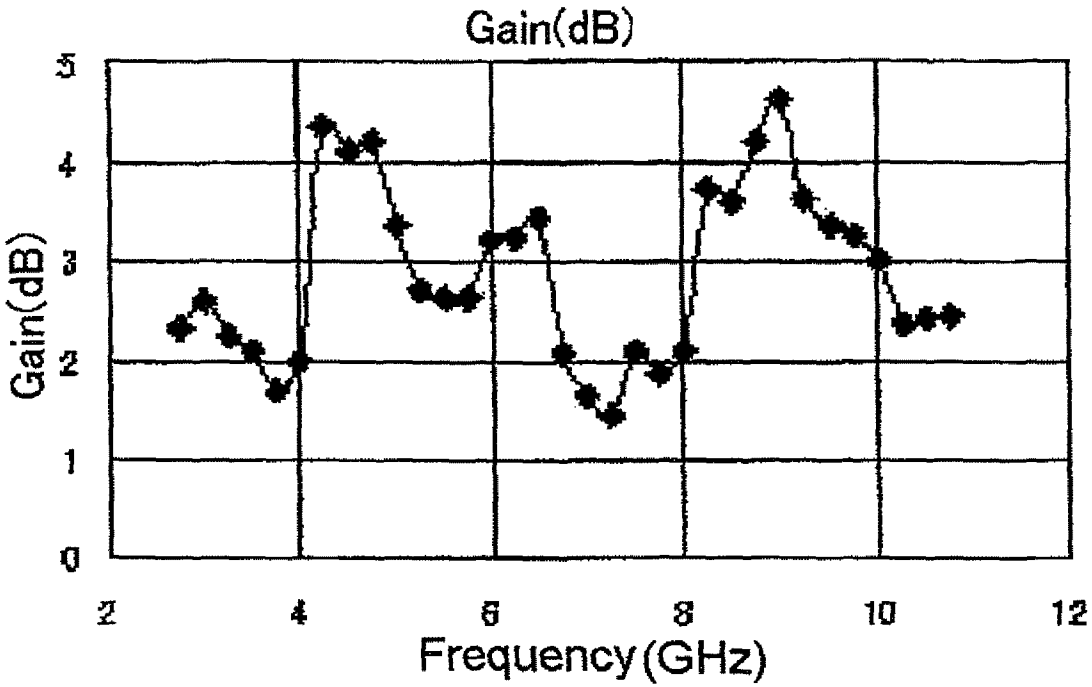
FIG. 6 is a gain characteristic diagram of the wide band antenna of the sizes shown in FIG. 4.
Figure 7:
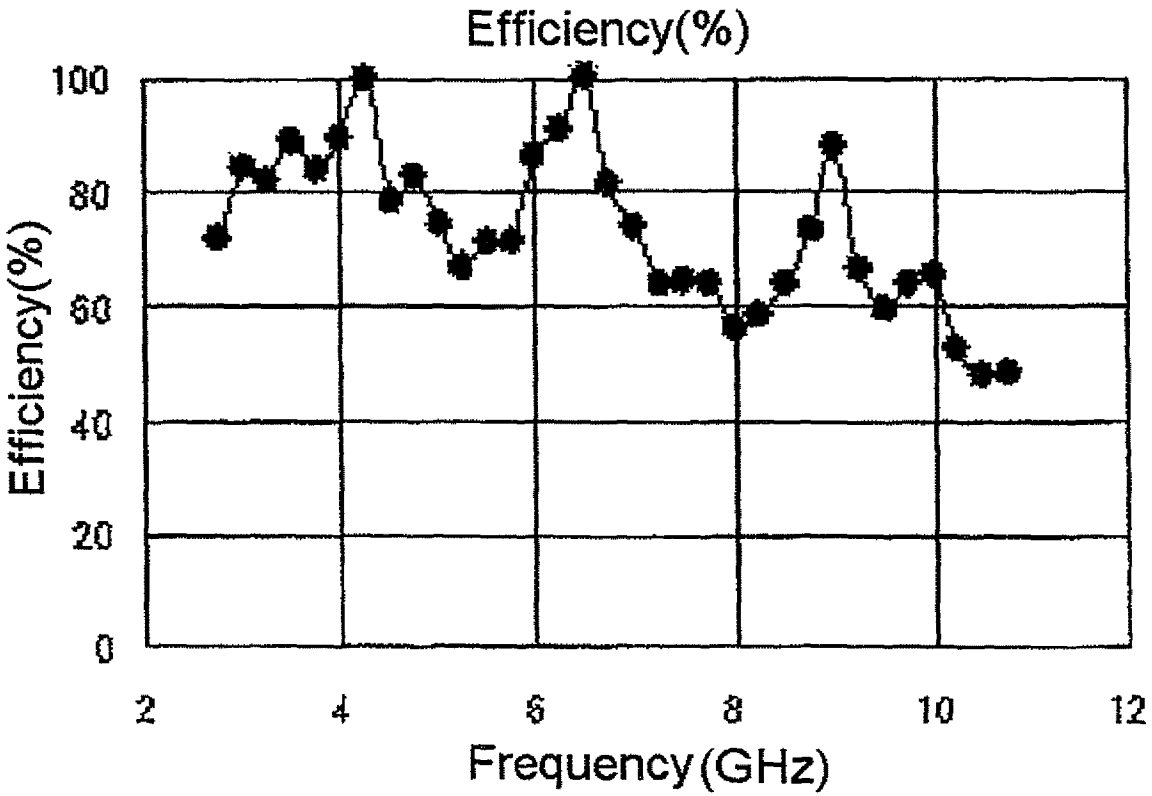
FIG. 7 is a radiation efficiency characteristic diagram of the wide band antenna of the sizes shown in FIG. 4.

FIG. 6 is a gain characteristic diagram of the wide band antenna 2 of the above sizes, and FIG. 7 is a radiation efficiency characteristic diagram. Black dots in those figures are simulation values at the used frequency. The gain of 1.5 dBi or higher and the high efficiency of 45% or higher are obtained in the wide frequency band of from 3.1 [GHz] to 10.6 [GHz].

Figure 8:
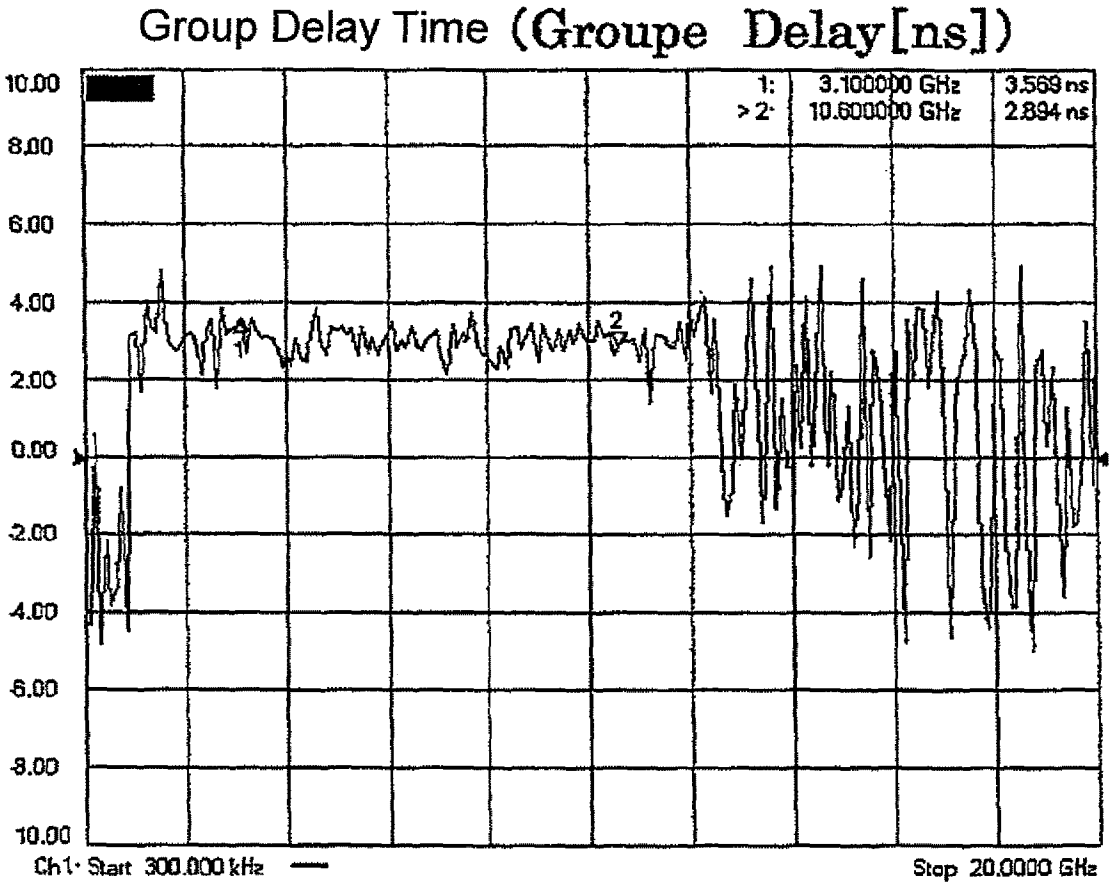
FIG. 8 is a group delay time characteristic diagram of the wide band antenna of the sizes shown in FIG. 4.

FIG. 8 is a group delay time characteristic diagram in the case of using two wide band antennas 2 of the above sizes. With the provision of the adjustment element shown in FIG. 1(*b*), the group delay time is substantially constant when at least the use frequency is 3.1 [GHz] or higher. The group delay time is 3.569 [ns] at 3.1 [GHz] and 2.894 [ns] at 10.6 [GHz]. Those numeric values are entirely satisfactory in practical use.

Figure 9:
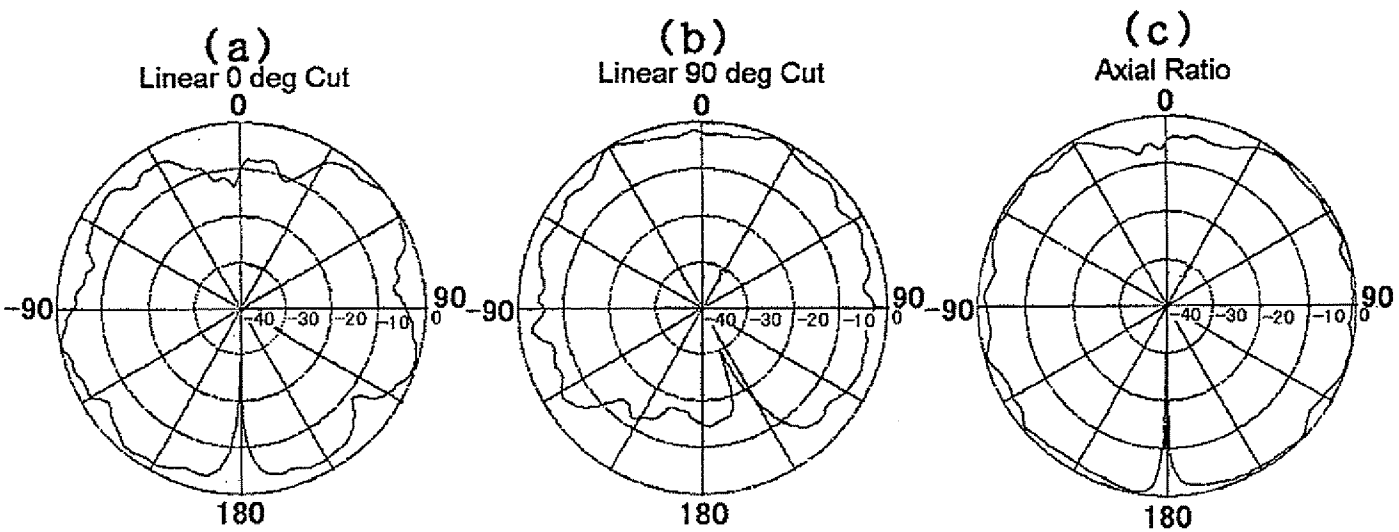
FIG. 9 are diagrams showing the directivity characteristic of the wide band antenna, in which part (a) is a directivity characteristic diagram in a direction that is in parallel to the antenna surface of the wide band antenna of the sizes shown in FIG. 4, part (b) is a directivity characteristic diagram in a planar direction that is vertically orthogonal to the antenna surface, and part (c) is a directivity characteristic diagram in the horizontal planar direction (3.5 [GHz]).
Figure 10:
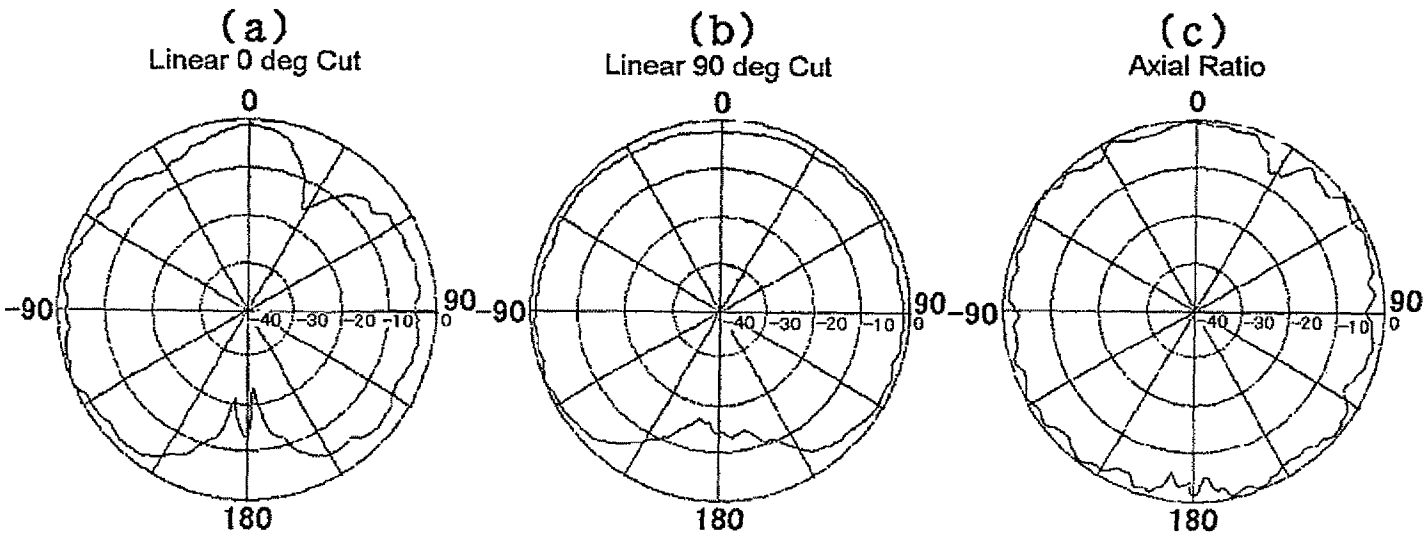
FIG. 10 are diagrams showing a directivity characteristic of the wide band antenna, in which part (a) is a directivity characteristic diagram in a direction that is in parallel to the antenna surface of the wide band antenna of the sizes shown in FIG. 4, part (b) is a directivity characteristic diagram in a planar direction that is vertically orthogonal to the antenna surface, and part (c) is a directivity characteristic diagram in the horizontal planar direction (6.0 [GHz]).
Figure 11:
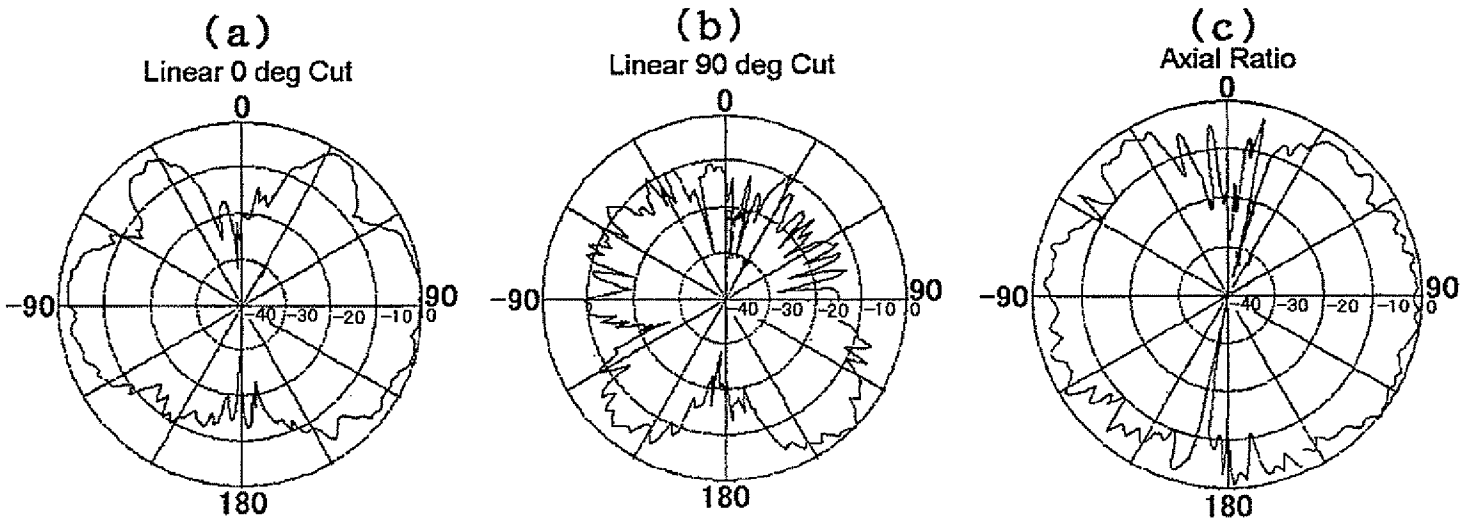
FIG. 11 are diagrams showing a directivity characteristic of the wide band antenna, in which part (a) is a directivity characteristic diagram in a direction that is in parallel to the antenna surface of the wide band antenna of the sizes shown in FIG. 4, part (b) is a directivity characteristic diagram in a planar direction that is vertically orthogonal to the antenna surface, and part (c) is a directivity characteristic diagram in the horizontal planar direction (10.0 [GHz]).

FIG. 9 show directivity characteristic diagrams when the antenna surface that is formed on the resin plate or the printed circuit board is located perpendicularly with respect to the horizontal surface, and the use frequency is 3.5 [GHz], in which FIG. 9(*a*) shows the directivity characteristic in a direction that is in parallel to the antenna surface, FIG. 9(*b*) shows the directivity characteristic in a direction that is vertically perpendicular to the antenna surface, and FIG. 9(*c*) shows the directivity characteristic in a horizontal direction, respectively. Likewise, FIGS. 10(*a*), 10(*b*), and 10(*c*) show the directivity characteristic diagrams in the respective directions when the use frequency is 6.0 [GHz], and FIGS. 11(*a*), 11(*b*), and 11(*c*) show the directivity characteristic diagrams in the respective directions when the use frequency is 10.0 [GHz], respectively.

It is found from those drawings that there is non-directivity over the wide frequency band.

As described above, it is found that the wide band antenna 2 is an antenna having all of the downsizing, the wide band property, the high efficiency, the low group delay time characteristic, and non-directivity.

[Verification of the Sizes of External Ground Conductor]

As described above, the wide band antennas 1 and 2 according to this embodiment have the characteristics conforming to the operation mode of the double cylinder ridge waveguide. The wide band antenna described above is not affected by the sizes of the external ground conductor. This will be verified.

Figure 12:
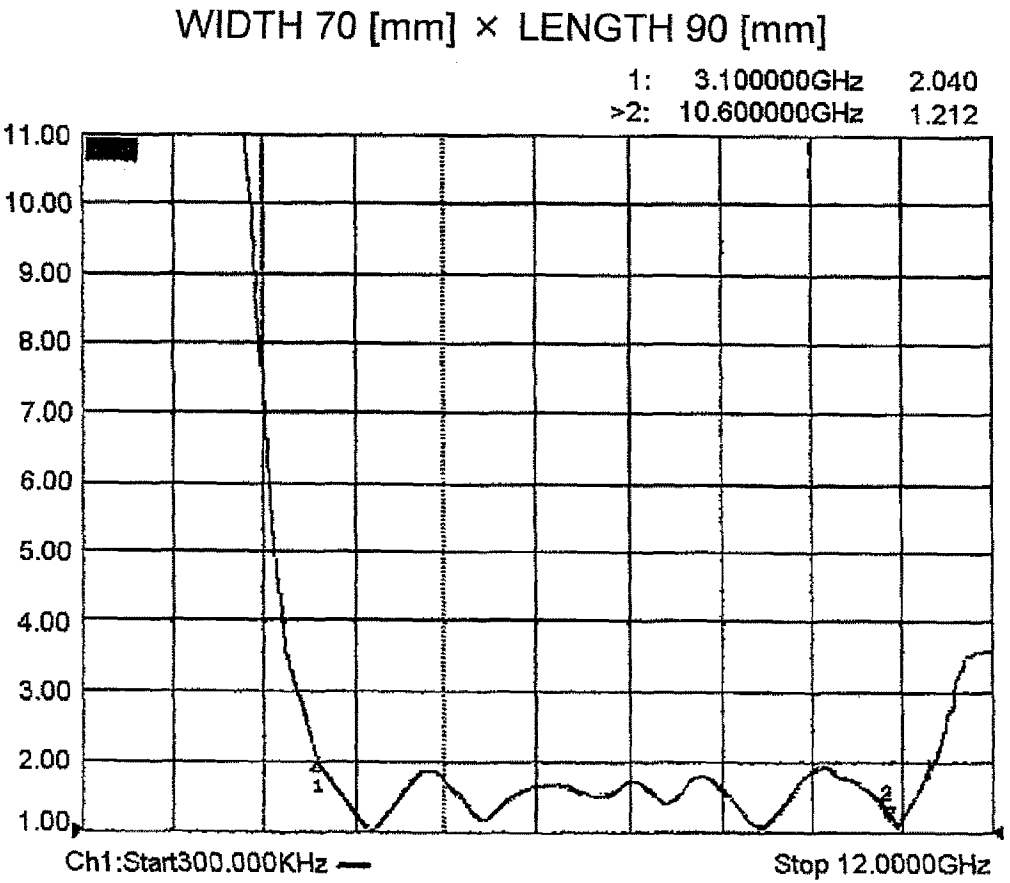
FIG. 12 is a VSWR characteristic diagram when the implementation body where the wide band antenna and the external ground conductor are joined together is 70 [mm] in width and 90 [mm] in length.
Figure 13:
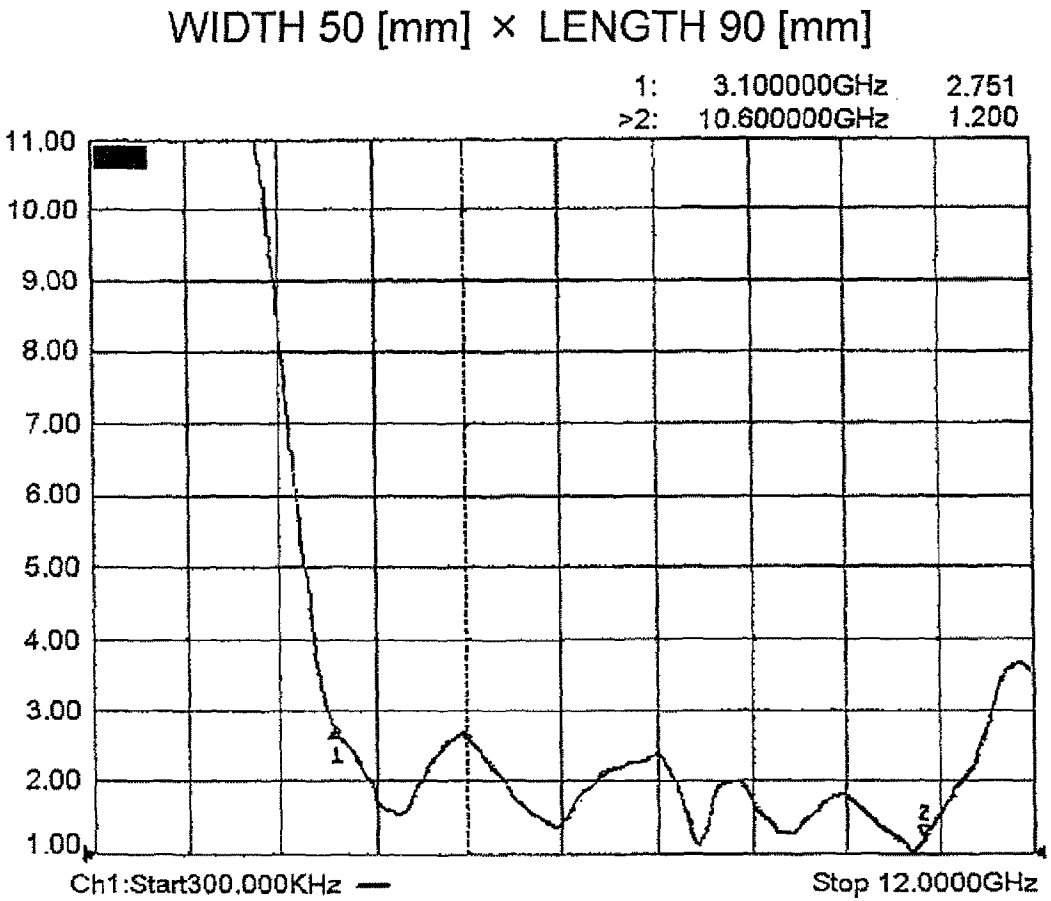
FIG. 13 is a VSWR characteristic diagram when the implementation body where the wide band antenna and the external ground conductor are joined together is 50 [mm] in width and 90 [mm] in length.
Figure 14:
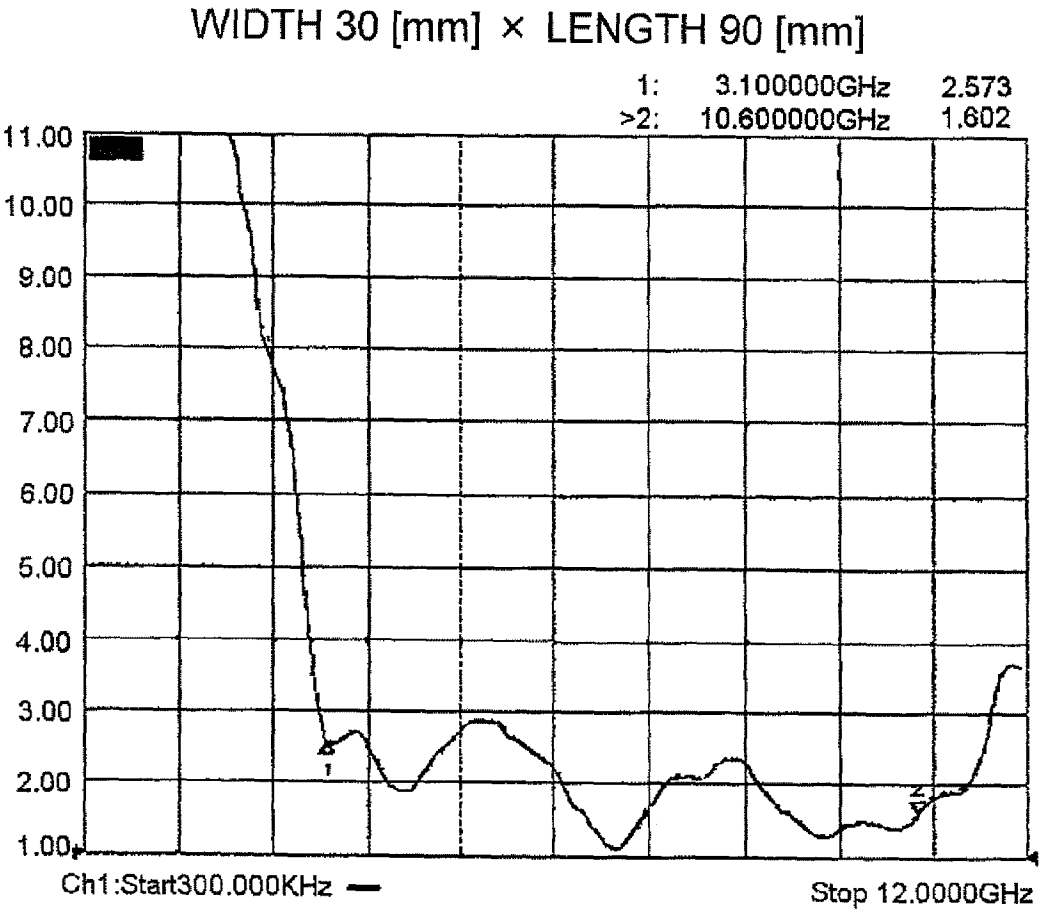
FIG. 14 is a VSWR characteristic diagram when the implementation body where the wide band antenna and the external ground conductor are joined together is 30 [mm] in width and 90 [mm] in length.

For example, FIGS. 12 to 14 show the VSWR characteristics when the total length (length in the longitudinal direction in the drawings) of the resin plate E20 and the external ground conductor G20 are held constant and the width is changed in the implementation state shown in FIG. 2(*b*). Also, FIGS. 15 to 18 show the VSWR characteristics when the width of the resin plate E20 (=external ground conductor G20) is held constant, and the length is changed.

FIG. 12 is an example in which the width is 70 [mm], and the length is 90 [mm]. The VSWR is 2.040 when the use frequency is 3.1 [GHz], and 1.212 when the use frequency is 10.6 [GHz]. FIG. 13 is an example in which the length (90 [mm]) is not changed, and the width is changed to 50 [mm]. The VSWR is 2.751 when the use frequency is 3.1 [GHz], and 1.200 when the use frequency is 10.6 [GHz]. FIG. 14 is an example in which the width is changed to 30 [mm], and the VSWR is 2.573 when the use frequency is 3.1 [GHz], and 1.602 when the use frequency is 10.6 [GHz].

Figure 15:
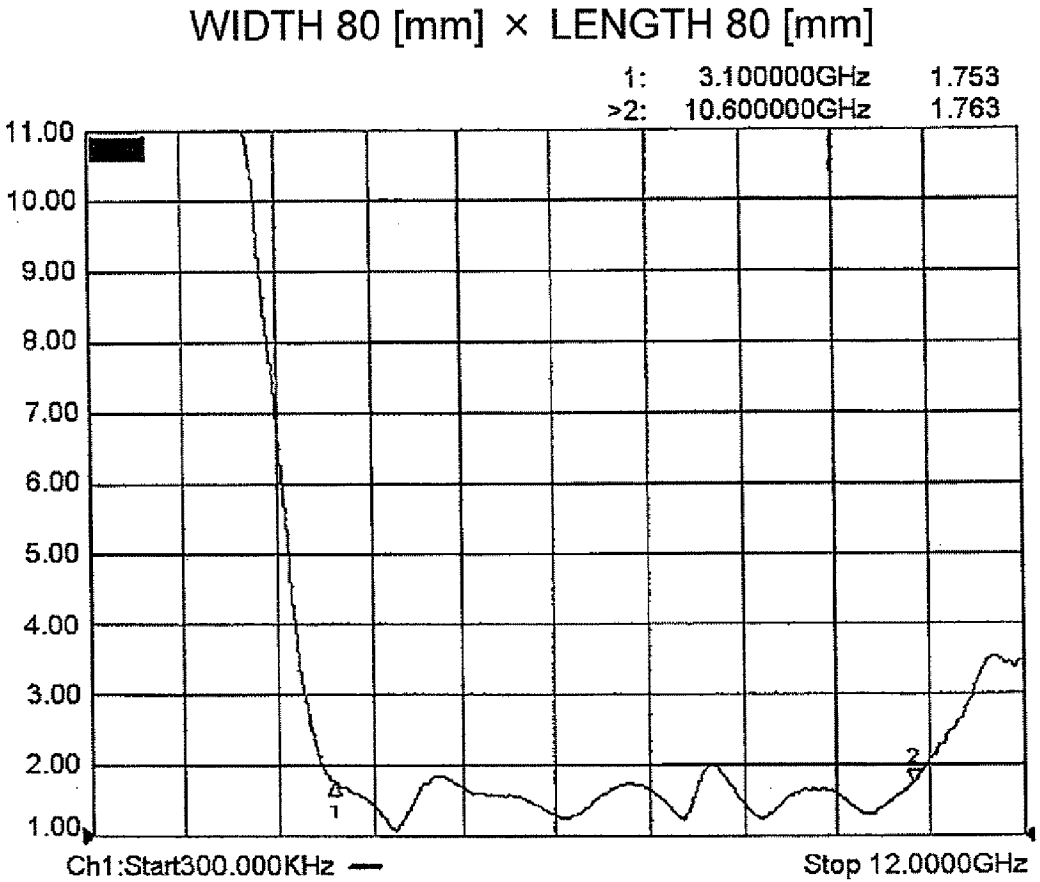
FIG. 15 is a VSWR characteristic diagram when the implementation body where the wide band antenna and the external ground conductor are joined together is 80 [mm] in width and 80 [mm] in length.
Figure 16:
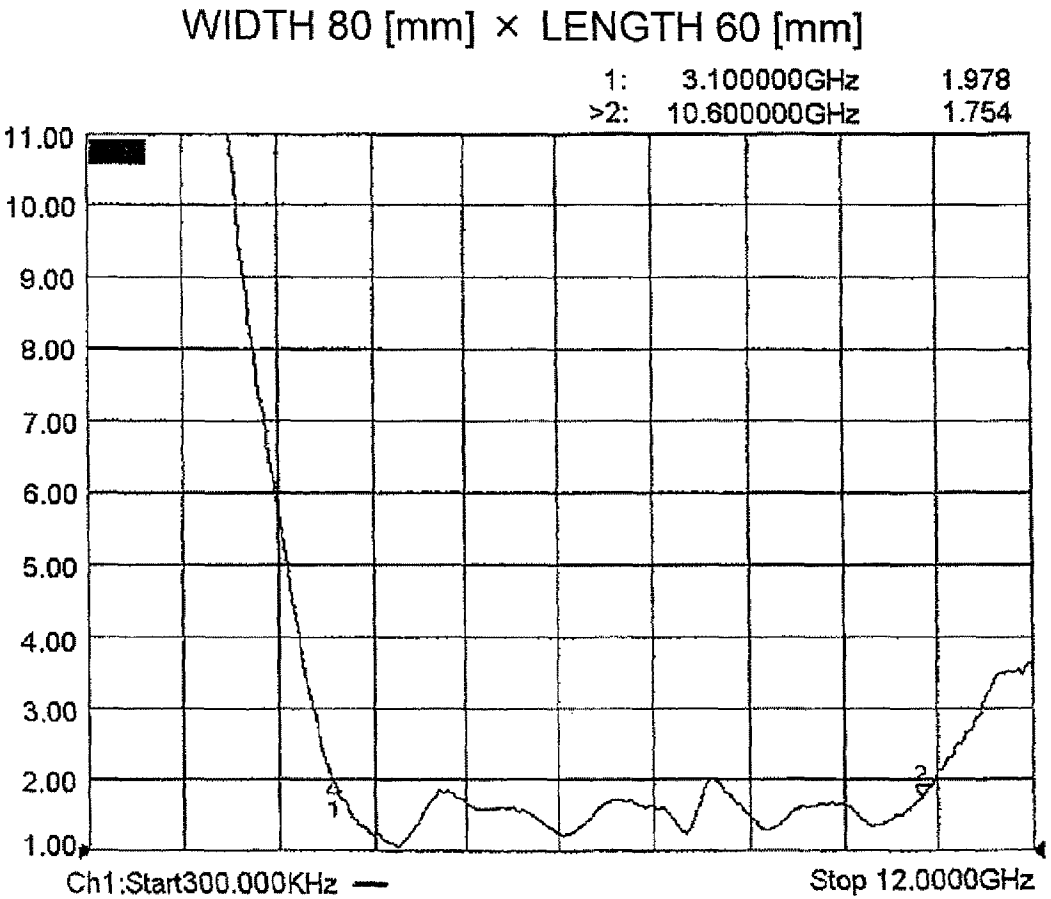
FIG. 16 is a VSWR characteristic diagram when the implementation body where the wide band antenna and the external ground conductor are joined together is 80 [mm] in width and 60 [mm] in length.
Figure 17:
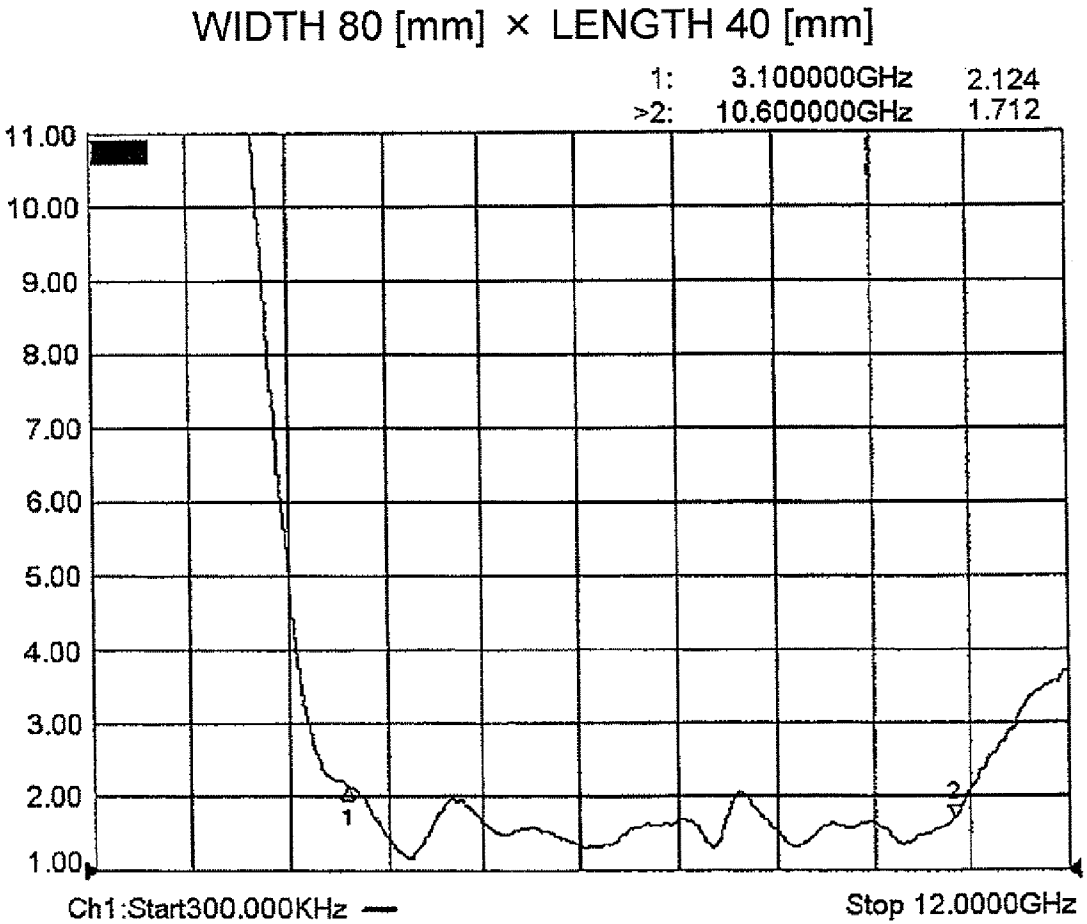
FIG. 17 is a VSWR characteristic diagram when the implementation body where the wide band antenna and the external ground conductor are joined together is 80 [mm] in width and 40 [mm] in length.
Figure 18:
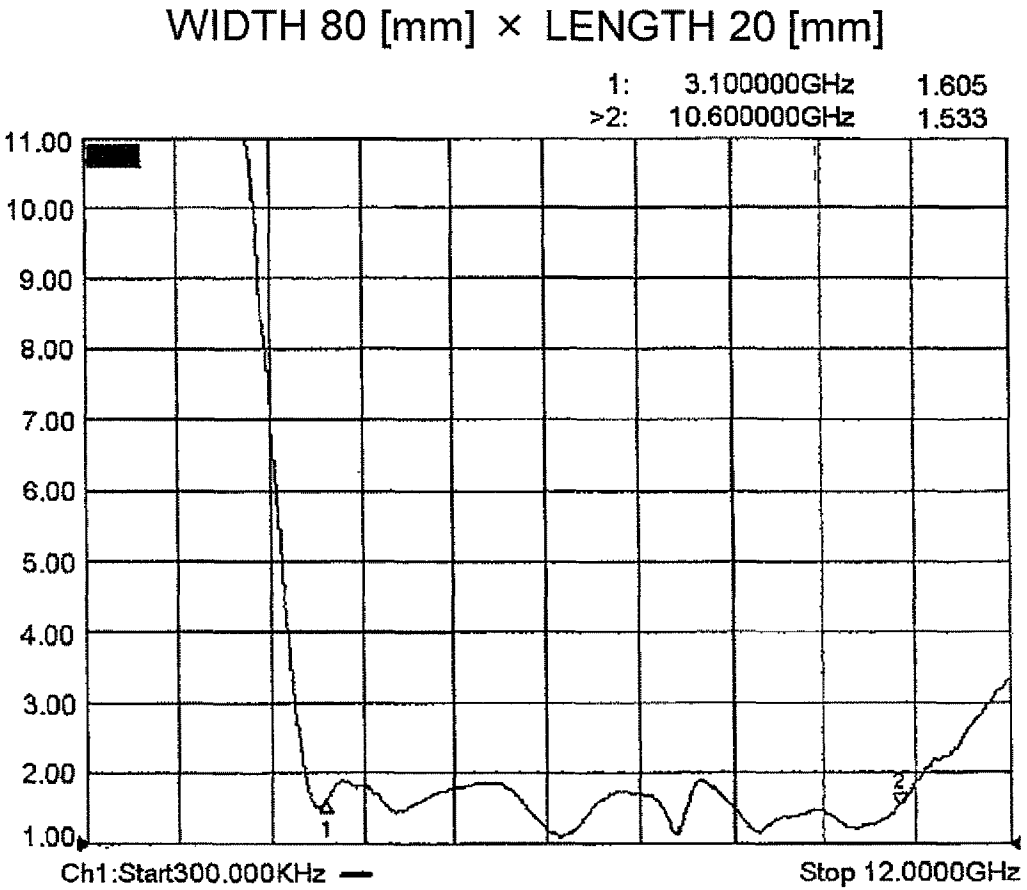
FIG. 18 is a VSWR characteristic diagram when the implementation body where the wide band antenna and the external ground conductor are joined together is 80 [mm] in width and 20 [mm] in length.

FIG. 15 is an example in which the width is 80 [mm], and the length is 80 [mm]. The VSWR is 1.753 when the use frequency is 3.1 [GHz], and 1.763 when the use frequency is 10.6 [GHz]. FIG. 16 is an example in which the width (80 [mm]) is not changed, and the length is changed to 60 [mm]. The VSWR is 1.978 when the use frequency is 3.1 [GHz], and 1.754 when the use frequency is 10.6 [GHz]. FIG. 17 is an example in which the length is further changed to 40 [mm], and the VSWR is 2.124 when the use frequency is 3.1 [GHz], and 1.712 when the use frequency is 10.6 [GHz]. FIG. 18 is an example in which the length is further changed to 20 [mm], and the VSWR is 1.605 when the use frequency is 3.1 [GHz], and 1.533 when the use frequency is 10.6 [GHz].

As described above, the wide band antenna 2 according to this embodiment hardly changes the performance even if the length and the width of the external ground conductor G20 are changed to any sizes. The above properties are extremely important as the antenna that is incorporated into the mobile terminal having diverse configuration, structure, and sizes. Also, it means that the antenna structure has a large permissible range when the antenna is designed and manufactured, and suitable for mass-production. In fact, when the wide band antenna is manufactured, there occurs a variation due to the machining error, the mismatching (particularly liable to occur due to millimeter waves) of the feeder coaxial connector and the cable, the installation error of the feeder terminal, the loss of the antenna material (loss or the like of the joint material), the measurement error, or the like. However, according to the structure of the planar wide band antenna of this embodiment, the substantially same characteristics as the simulation results are obtained even if a slight variation in the design and manufacture occurs. That is, the basic portion such as the downsizing, the high efficiency, and the ultra wide band property are maintained.

It is presumed that the above facts are based on factors that the antenna element is so configured as to partially include the opening cross section structure of the double cylinder ridge waveguide, and both of the ridge element portion 21 and the ground portion 23*a* are substantially arc-configured.

The above properties of the planar wide band antenna according to this embodiment are remarkably proper for a UWB communication whose intended use is expected to be dramatically enlarged in the future, particularly, for the built-in antenna for the mobile terminal.

Figure 19:
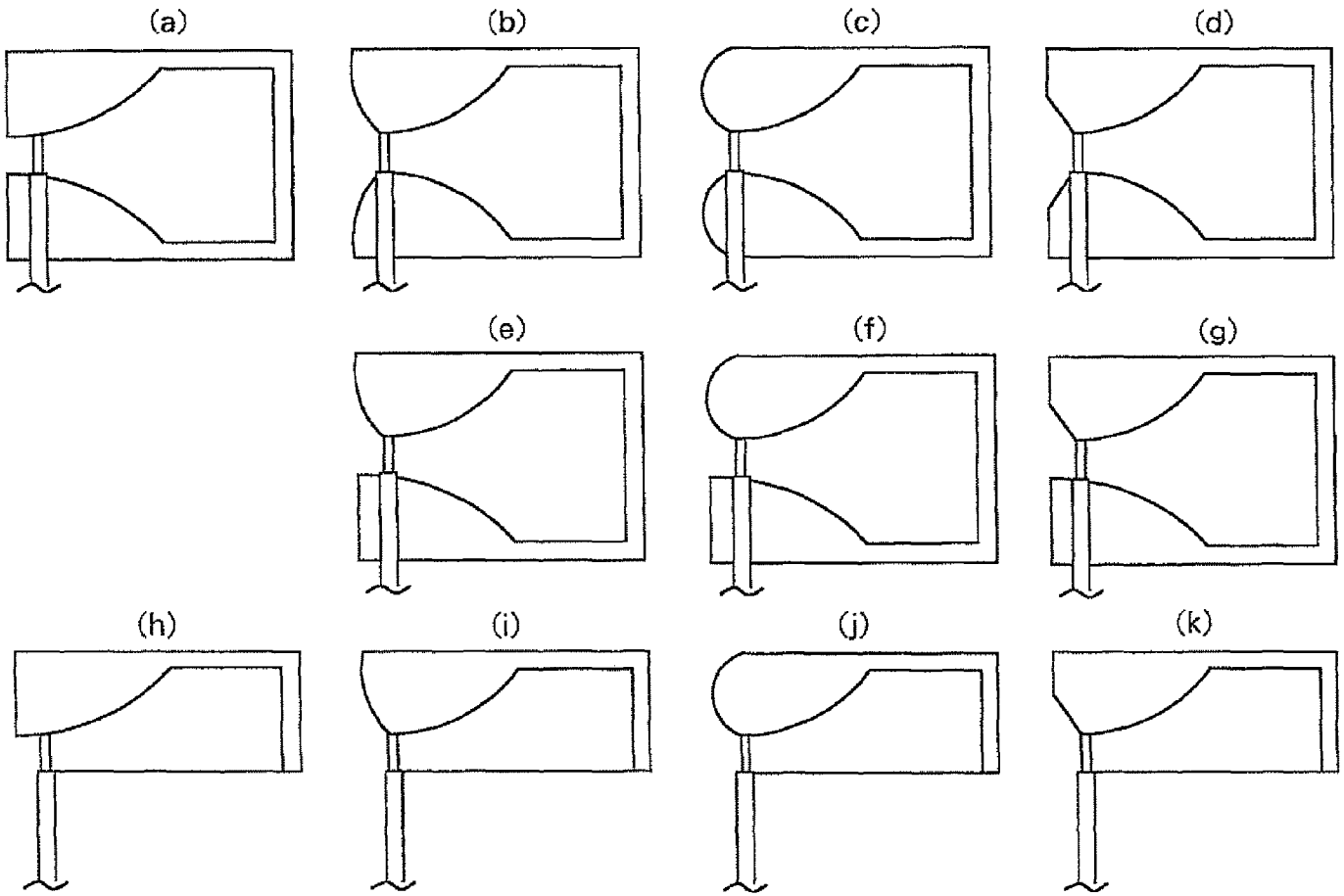
FIGS. 19(*a*) to 19(*k*) are diagrams showing modified examples of the antenna pattern.

The pattern of the antenna element of the planar wide band antenna is not limited to the examples shown in FIGS. 1(*a*) and 1(*b*), but various patterns can be applied. For example, as shown in FIGS. 19(*a*) to 19(*g*), the configurations of the ridge element portion and the ridge portion of the ground portion can be variously combined together for use. FIGS. 19(*h*) to 19(*k*) are an example in which no ground portion is provided. Even if no ground portion is provided in this way, the external ground conductor is attached, thereby making it possible to obtain substantially the same characteristics as those of the antenna having the ground portion.

Figure 20:
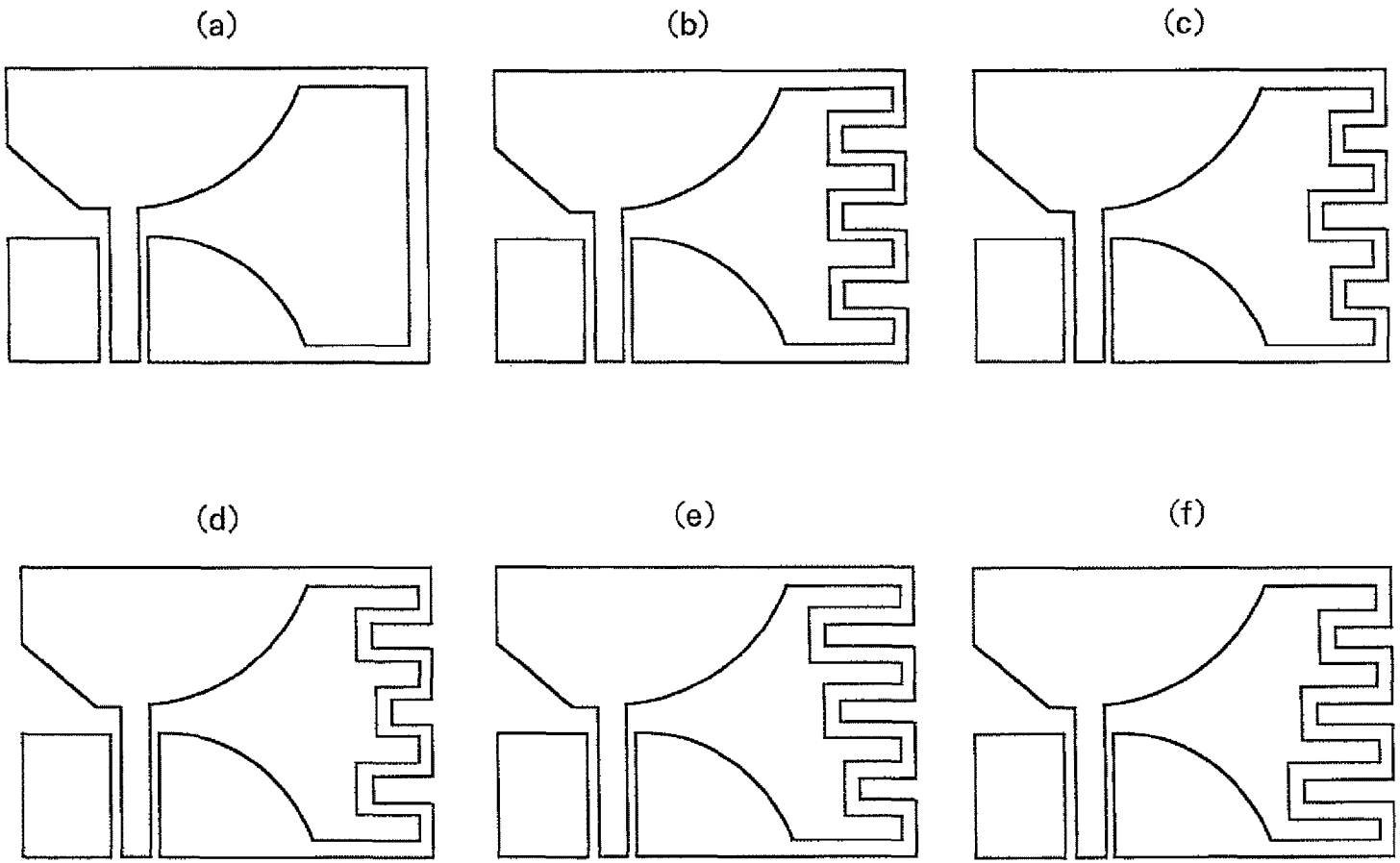
FIGS. 20(*a*) to 20(*f*) are diagrams showing modified examples of the antenna pattern.

FIGS. 20(*a*) to 20(*f*) are a modified example of the planar wide band antenna having a CPW structure. FIGS. 20(*a*) to

20(*f*) are a modified example of the pattern shown in FIG. 1(*b*). The configuration of meander is modified according to the antenna material, the use frequency band, and a variation of the group delay time for use.

(Advantages of the Wide Band Antenna According to this Embodiment)

The features of the planar wide band antenna of this embodiment reside in the antenna of the ultra wide band having only the lowest available frequency on the basis of the operation mode of the double cylinder ridge waveguide, and non-directivity. The above characteristics are remarkably important for a general purpose antenna for the UWB communication whose intended use is expected to be dramatically enlarged in the future.

The sizes, the material, and the like of the wide band antenna (UWB communication antenna) disclosed in the present specification are exemplified, and the implementation without departing from the features of the present invention is within the scope of the present invention.

Second Embodiment

In a second embodiment, a description will be given of a mode example in which the present invention is implemented as the wide band antenna that is used in the radio LAN communication and the UWB communication. In this example, the present invention is applied to the wide band antenna having the opening cross section structure of the double cylinder ridge waveguide.

Figure 21:
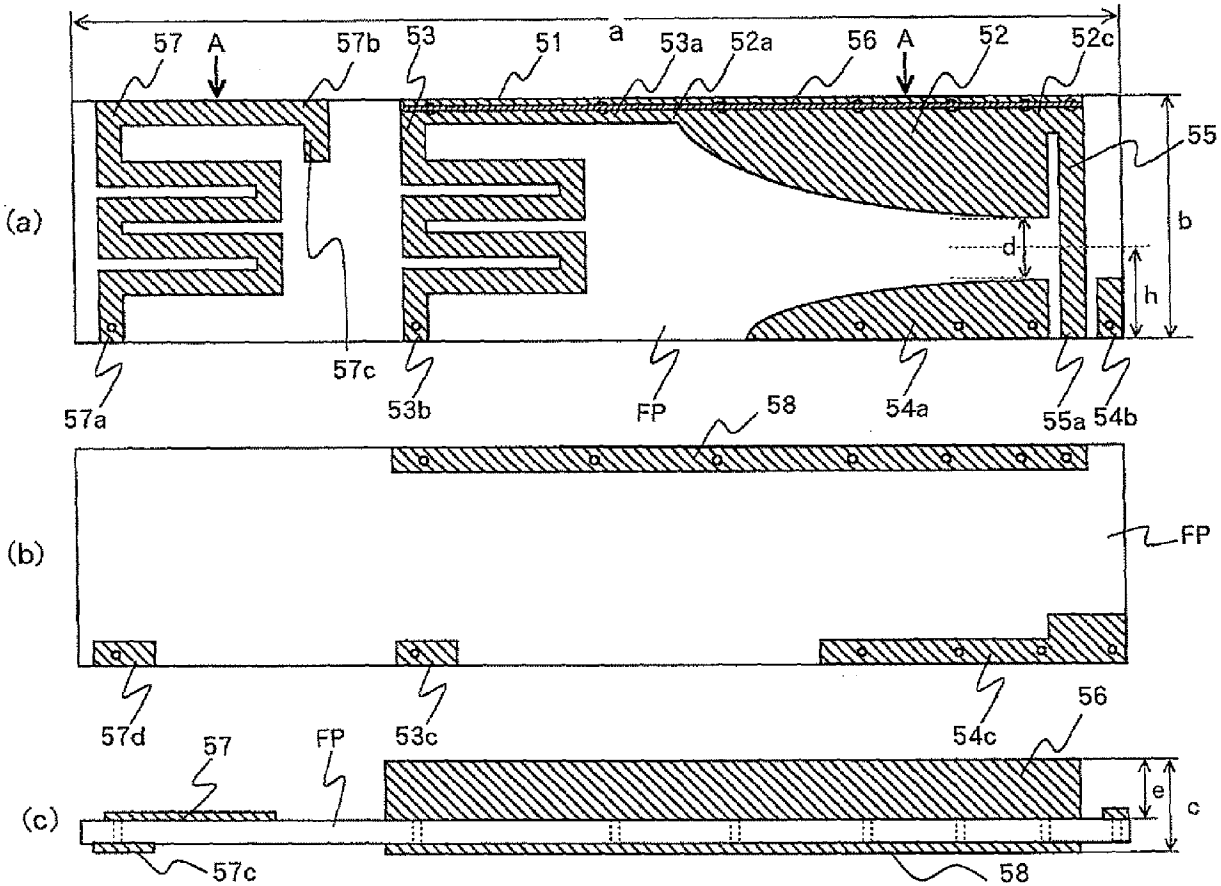
FIG. 21 are pattern diagrams showing the CPW structure of an antenna element of a wide band antenna according to a second embodiment of the present invention, in which part (a) is a front view, part (b) is a side view, and part (c) is a rear view.

FIG. 21(*a*) shows an example of a wide band antenna 51 that is suitable for use in the mobile terminal. The antenna element of the wide band antenna 51 has a ridge element portion 52, a first radiation element portion 53, ground portions 54*a* and 54*b*, a feeder wire 55, an erection element portion 56, and a second radiation element portion 57.

The ridge element portion 52 is configured in such a manner that a portion corresponding to one ridge portion of the double cylinder ridge waveguide is cut at an eccentric position where the larger amount of ridge portion remains from the center line in the height direction.

The first radiation element portion 53 has one end side 53*a* connected to a non-cut end side 52*a* of the ridge element portion 52, and a part of the one end side 53*a* is formed in a meander configuration in order to enhance the radiation efficiency. Note that the other end 53*b* of the first radiation element portion 53 is connected to a ground conductor 53*c* on a rear surface side shown in FIG. 21(*b*) through a through-hole that penetrates through a flat plate FP that is made of resin.

Also, the ridge element portion 52 and the first radiation element portion 53 are connected to a metal plate 58 that is formed on the rear surface side of the flat plate FP made of resin shown in FIG. 21(*b*) through a through-hole that penetrates through the flat plate FP made of resin. The metal plate 58 will be described later.

The ground portion 54*a* is a portion corresponding to the other ridge portion of the double cylinder ridge waveguide, and the ridge portion is so formed as to face the ridge portion of the ridge element portion 52.

The feeder wire 55 is connected to the cut end side 52*c* of the ridge element portion 52, and formed along a direction of the length b of the wide band antenna 51. The leading end portion 55*a* of the feeder wire is formed with a feeder terminal.

The ground portion 54*b* has a CPW structure that guides the feeder wire 55 to the external as a coplanar waveguide in cooperation with the ground portion 54*a*. That is, the ground portion is constituted by a pair of conductors 54*a* and 54*b* with the feeder wire 55 on the same surface at a given gap. The application of the above CPW structure makes it possible to suppress the impedance mismatching at the feeder terminal.

The ground portions 54*a* and 54*b* are connected to the ground terminal 54*c* that is formed on the rear surface side shown in FIG. 2(*b*) through the through-hole that penetrates, through the flat plate FP made of resin shown in FIG. 2(*b*).

FIG. 21(*c*) is a side view of the wide band antenna shown in FIG. 21(*a*) taken along a direction of the arrow A shown in FIG. 21(*a*).

The erection element portion 56 is so arranged as to erect substantially perpendicularly to a surface including the ridge element portion 52 and the first radiation element portion 53 at an end portion including a connection portion of the ridge element portion 52 and the first radiation element portion 53. The erection element portion 56 is connected to the ridge element portion 52 and the first radiation element portion 53.

The erection element portion 56 has projections (not shown) that can be inserted into the through-holes that are formed in the ridge element portion 52 and the first radiation element portion 53. The erection element portion 56 is welded to the ridge element portion 52, the first radiation element portion 53, and the metal plate 58 on the rear surface side shown in FIG. 21(*b*) in a state where the projections are inserted into the through-holes.

Also, the length b of the ridge element portion 52 and the first radiation element portion 53 are so set to be shorter than that in the case of the wide band antenna having no erection element portion 56 by a height e of the erection element portion 56.

In general, when the length b of the ridge element portion 52 is shortened, the impedance matching characteristic and the radiation characteristic of the wide band antenna 51 are deteriorated. However, the provision of the above erection element portion 56 makes it possible to maintain or improve the impedance matching characteristic and the electromagnetic radiation characteristic of the wide band antenna 51 even if the wide band antenna 51 is shortened along the direction of the length b.

That is, the erection element portion 56 is connected to the ridge element portion 52 and the first radiation element portion 53, thereby making it possible to reduce the sizes of the wide band antenna 51 in the direction of the length b without deteriorating the impedance matching characteristic and the radiation characteristic.

In this example, the erection element portion 56 is welded to the ridge element portion 52 and the first radiation element portion 53. Alternatively, the erection element portion 56 may be formed by bending the end portions of the ridge element portion 52 and the first radiation element portion 53 at a right angle by the length e.

Also, the erection element portion 56 shown in this example erects from the surface where the ridge element portion 52 and the first radiation element portion 53 of the flat plate FP are formed. Alternatively, the erection element portion 56 can be so arranged as to erect from an opposite surface (surface on which the metal plate 58 is formed) of the flat plate FP.

Also, in this example, the erection element portion 56 erects substantially perpendicularly to the surface including the ridge element portion 52 and the first radiation element portion 53. However, an angle of the erection element portion 56 can be freely set according to the space or the like at the time of implementation.

Note that, in this example, the erection element portion 56 is connected to both of the ridge element portion 52 and the first radiation element portion 53. However, the erection element portion may be shorter in the direction of the length a, or the erection element portion 56 may be connected to only the ridge element portion 53 in order to adjust the impedance.

The second radiation element portion 57 is so disposed as to be adjacent to the first radiation element portion 53 at a given interval. One end 57*a* of the second radiation element portion 57 is connected to a ground conductor 57*d* on the rear surface side shown in FIG. 21(*b*) from an end portion of the flat plate FP that is made of resin through a through-hole. The one end 57*a* is grounded on the rear surface side. The second radiation element portion 57 is capacitively coupled with the first radiation element portion 53, and used for electromagnetic wave radiation. Also, in order to enhance the radiation efficiency, the second radiation element portion 57 is partially formed in a meander configuration as with the first radiation element portion 53.

Further, the other end 57*b* of the second radiation element portion 57 has an extension portion 57*c* that extends in the direction of the length b. The formation of the extension portion 57*c* makes the associativity of the first radiation element portion 53 and the second radiation element portion 57 further excellent.

In this example, the second radiation element portion 57 has substantially the same configuration as that of the first radiation element portion 53. Alternatively, the configuration can be different from that of the first radiation element portion 53. For example, the meander configuration of the second radiation element portion 57 can be symmetrical with the first radiation element.

Also, in this example, the second radiation element portion 57 is so formed as to be adjacent to the first radiation element portion 53 at a given interval. Alternatively, as in a wide band antenna 51' shown in FIG. 22, the second radiation element portion 57 can be formed on an opposite side of the ridge element portion 52 viewed from the first radiation element portion 53, that is, so as to sandwich the ridge element portion 52 by the second radiation element portion 57 and the first radiation element portion 53. In this case, the second radiation element portion 57 is capacitively coupled with the ridge element portion 52.

Note that the adjustment element portion required in the planar wide band antenna of the first embodiment is not always required because the variations in the group delay characteristic and the transmission waveform characteristic are improved by the provision of the second radiation element portion 57. As a result, no adjustment element portion is disposed in the wide band antenna 51 of the second embodiment.

Figure 23:
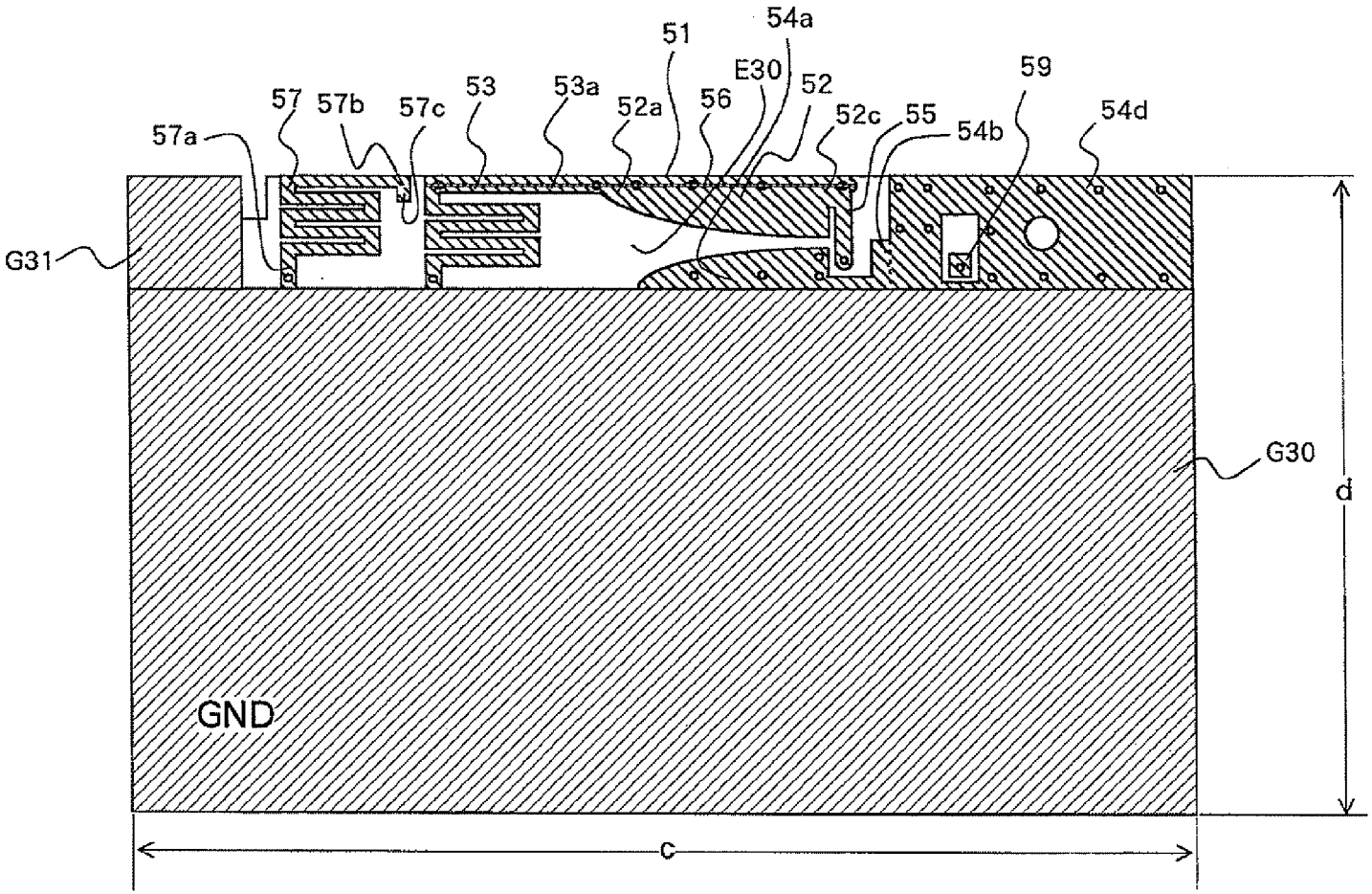
FIG. 23 is a front view showing the implementation state of the wide band antenna according to the second embodiment.

The wide band antenna 51 shown in FIG. 21 is configured as shown in FIG. 23 when the wide band antenna 51 is implemented in a communication device.

As shown in FIG. 23, the wide band antenna 51 shown in FIG. 21 is fitted to a resin plate E30, and the ground portions 54*a* and 54*b* of the wide band antenna 51 are joined to an external ground conductor G30. In this example, the ground portion 54*b* is molded integrally with a ground portion 54*d* at the time of implementation. Also, a ground conductor G31 that is connected to the external ground conductor G30 is disposed at the left side of the second radiation element 57. All of the wide band antenna 51, the ground portion 54*d*, the external ground conductor G30, and the ground conductor G31 are fitted to the resin plate E30.

Also, the feeder wire 55 of the wide band antenna 51 is connected to a joint portion 59 disposed on the external ground conductor G30 through the interior of the resin plate E30. The feeder wire 55 is connected with, for example, a core that is exposed from one end of a semi rigid cable not shown through the joint portion 59. The other end of the semi rigid cable is fitted with a coaxial connector for connection to an electronic circuit not shown.

Figure 22:
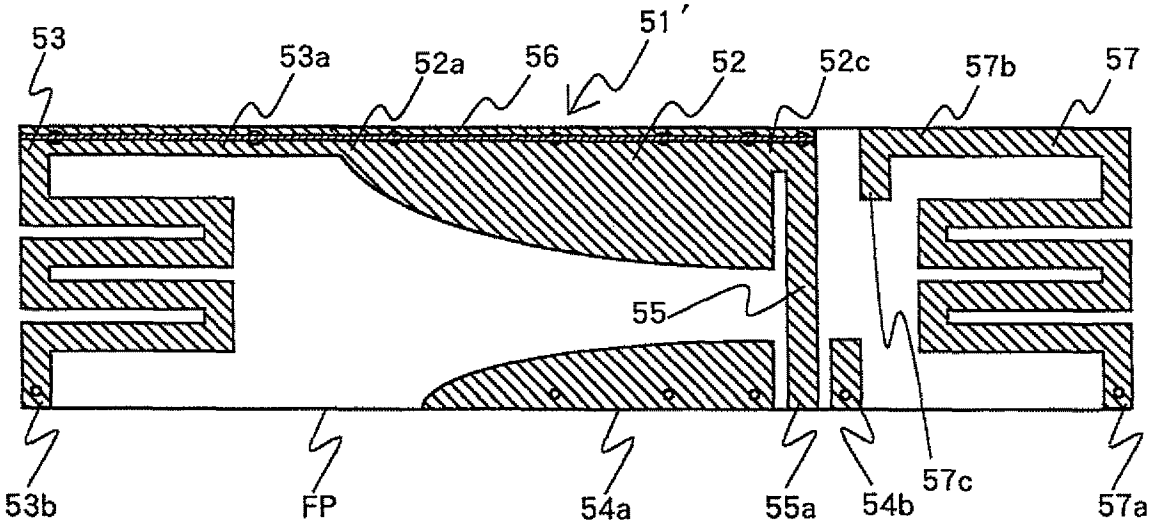
FIG. 22 is a pattern diagram showing a modified example of the CPW structure of an antenna element of the wide band antenna according to the second embodiment of the present invention.

Note that, the antenna pattern, the pattern of the joint portion, and the ground conductor pattern shown in FIGS. 21 and 22 can be formed on one resin printed circuit board with metal films.

(Antenna Characteristics)

Subsequently, a description will be given in more detail of the antenna characteristics of the wide band antenna 51 shown in FIG. 21.

The wide band antenna 51 is 2.4 [GHz] and 3.1 [GHz] or higher in the use frequency band. The use frequency band of 3.1 [GHz] or higher is obtained by the ridge element portion 52 and the first radiation element portion 53. The use frequency band of 2.4 [GHz] is obtained by the second radiation element portion 57.

The size of the wide band antenna 51 is 4.8 [mm] in the thickness c of the entire antenna element, 36 [mm] in the length a of the ridge element portion 52, the first radiation element 53, and the second radiation element portion 57, 7 [mm] in the length b of the first radiation element portion 3, and 4 [mm] in the height e of the erection element portion 56. The thickness of the resin plate FP is 0.8 [mm].

The gap d between the leading end of the ridge element portion 52 and the leading end of the ground portion 54*d* is changed, thereby making it possible to finely adjust the impedance. Also, the length h between the center of the gap d and the external ground conductor is changed, thereby making it possible to finely adjust the use frequency band that is obtained by the ridge element portion 52 and the first radiation element portion 53.

Note that the gap d is about 1 [mm], and h is about 3 [mm].

In the wide band antenna 51 of the above size, the results of simulating the characteristics of the antenna having an ideal configuration without any error, which is designed by software on the basis of the Maxwell's electromagnetic theory and the antenna design theory, for example, on a computer are indicated below. The simulation is conducted because the measuring gauge only supports up to about 12 [GHz] as of today. It is confirmed that the results of the simulation hardly differs from the actual measurements within a measured range.

Figure 24:
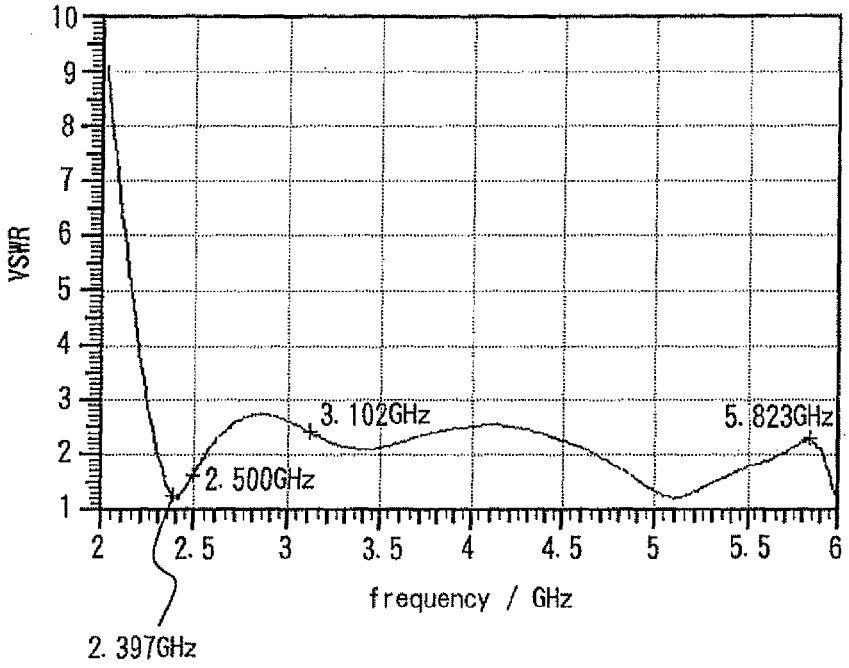
FIG. 24 are diagrams showing the characteristic of the wide band antenna shown in FIG. 21, in which part (a) is a VSWR characteristic diagram, and part (b) is a radiation efficiency characteristic diagram.
Figure 24:
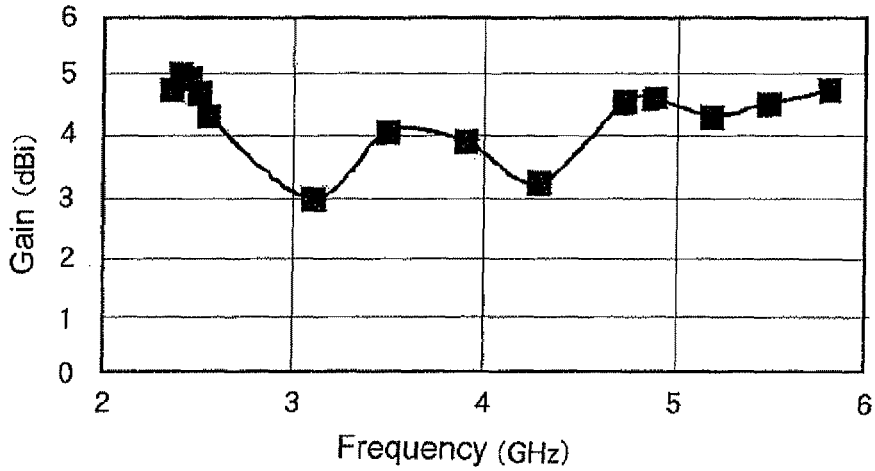

FIG. 24 show the VSWR characteristic diagrams and the simulation results of the gain characteristic which are obtained when the wide band antenna 51 of the above size is implemented as shown in FIG. 23. In obtaining the characteristics, the interval d and the length h in FIG. 21 are adjusted to set the use frequency band that is obtained by the ridge element portion 52 and the first radiation element portion 53 to 3.1 [GHz] or higher.

As is apparent from FIG. 24(*a*), all of VSWR of the frequencies that are higher than 2.4 [GHz] fall within the practical use range (3 or lower). Specifically, VSWR is 1.7 or lower at 2.4 to 2.5 [GHz], 2.5 or lower at 3.1 to 4.75 [GHz], and 2.2 or lower at 4.9 to 5.825 [GHz]. For convenience of the gauge, although quantification using numeric values was not conducted at 6 [GHz] or higher, it is confirmed that VSWR is excellently maintained even at the high frequency of 6 [GHz] or higher.

Also, as is apparent from the gain characteristics of FIG. 24(*b*), the gain of the frequency higher than 2.4 [GHz] is obtained as a high value of 3.0 dBi or higher.

Figure 25:
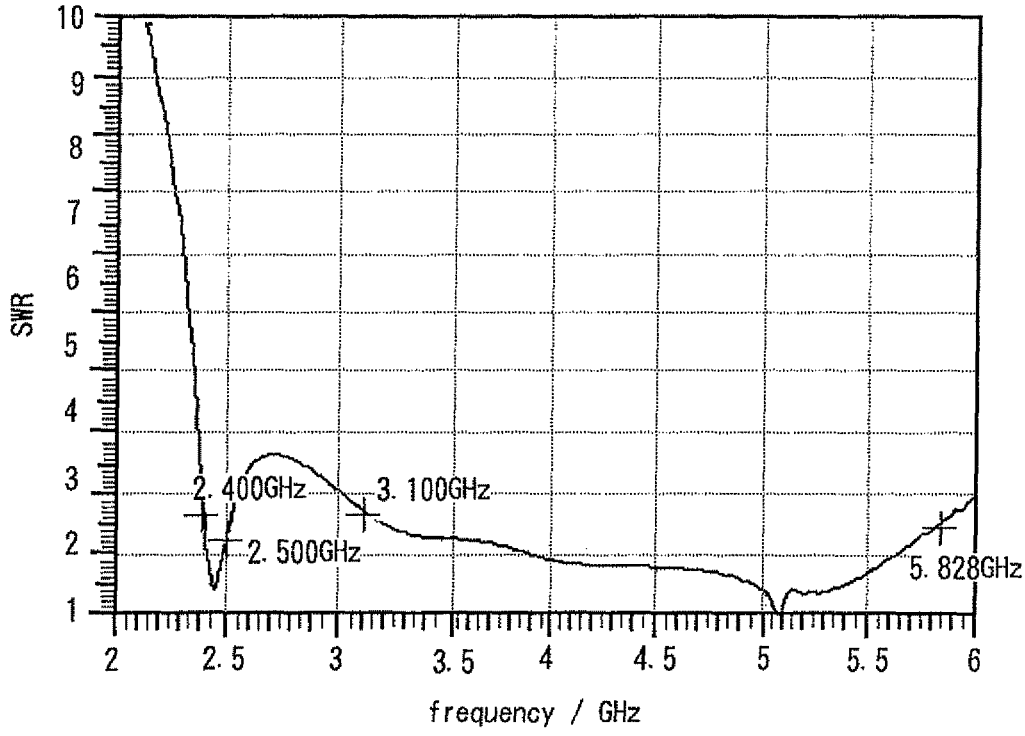
FIG. 25 is a VSWR characteristic diagram of the wide band antenna shown in FIG. 22.

FIG. 25 shows the VSWR characteristics of the wide band antenna 51' shown in FIG. 22.

Even if the second radiation element portion 57 is disposed on the ridge element portion 52 side in this way, all the characteristics of the VSWR obtained at the frequencies higher than 2.4 [GHz] fall within the practical use range (about 3 or lower). In particular, apart from 2.5 to 3.1 [GHz] that are the frequency bands that do not actually use the wide band antenna 51, VSWR is obtained as an excellent value of 3 or lower, which is the characteristics of the satisfactory level to be used in the radio LAN communication with the use frequency band of 2.4 [GHz] and the UWB communication with the use frequency band of 3.1 [GHz] or higher.

In obtaining the characteristics shown in FIG. 25, the arrangement of the second radiation element 57 is different from that in the wide band antenna 51 shown in FIG. 21(*a*), but all the other conditions are identical.

Figure 26:
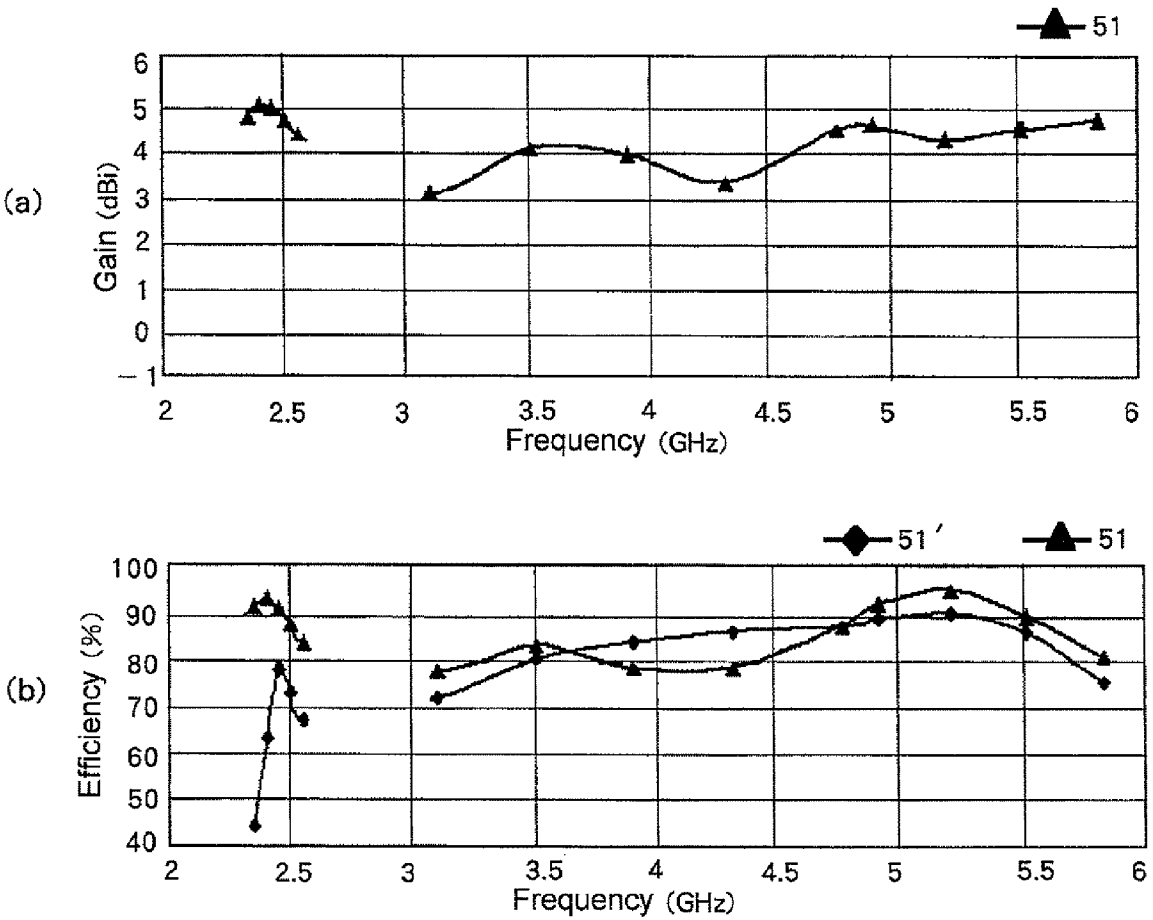
FIG. 26 are diagrams showing the characteristic of the wide band antenna shown in FIG. 23, in which part (a) is a gain characteristic diagram, and part (b) is a radiation efficiency characteristic diagram.

FIG. 26(*a*) is a gain characteristic diagram of the wide band antenna 51, and FIG. 26(*b*) is a radiation efficiency characteristic diagram. Those characteristics are measured in a state where the wide band antenna 51 is fitted to the resin plate E30, and the ground portions 54*a* and 54*b* of the wide band antenna 51 are joined to the external ground conductor G30 and the ground conductor G31 as shown in FIG. 23. In this situation, the total dimensions of the wide band antenna 51, the ground portion 54*d*, the external ground conductor G30, and the ground conductor G31 are 200 mm in the length c and 100 mm in the length d shown in FIG. 23.

Black dots in those figures are simulation values at the used frequencies. Among those black dots, the triangular black dots indicate the simulation values of the wide band antenna 51, and the rhombic black dots indicate the simulation values of the wide band antenna 51'.

In the wide band antenna 51, the gain of 3.0 dBi or higher and the high efficiency of 75% or higher are obtained in the frequency band of from 2.5 [GHz] and 3.1 [GHz] to about 6 [GHz].

Also, in the wide band antenna 51', the high efficiency of 45% or higher is obtained in the frequency bands of from 2.5 [GHz] and 3.1 [GHz] to about 6 [GHz]. Note that it is confirmed that the same gain as that of the wide band antenna 51 is obtained.

Through the above description, it can be confirmed that the wide band antennas 51 and 51' are practical at the frequency bands of from 2.4 [GHz] and 3.1 [GHz] to about 6 [GHz], and can be used for the radio LAN communication and the UWB communication.

Figure 27:
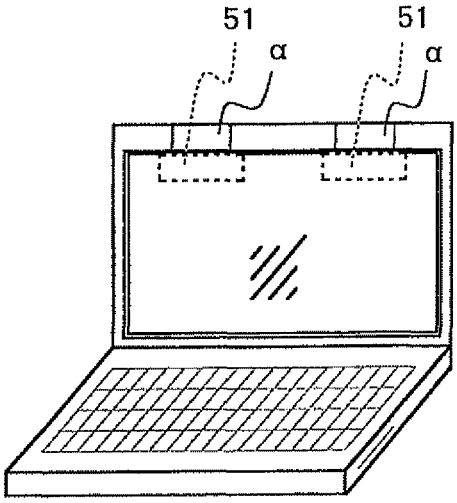
FIG. 27 is a perspective view showing the implementation state of implementing the wide band antenna shown in FIG. 21 into a personal computer.

FIG. 27 is a conceptual diagram showing an installation location in the case where two wide band antennas 51 are installed in a notebook personal computer of A4 size. The wide band antennas 51 are incorporated into the rear side of the liquid crystal panel. In this situation, it is preferable that one of the elements of those two antennas has a pattern shown in FIG. 21, and the other element has a pattern symmetrical with that shown in FIG. 21. In the case where the wide band antennas 51 are incorporated into the notebook personal computer, because a space is extremely limited, it is preferable that the erection element portion 56 is disposed not at the rear side of the liquid crystal panel, but at an edge a of the casing of the notebook personal computer.

Figure 28:
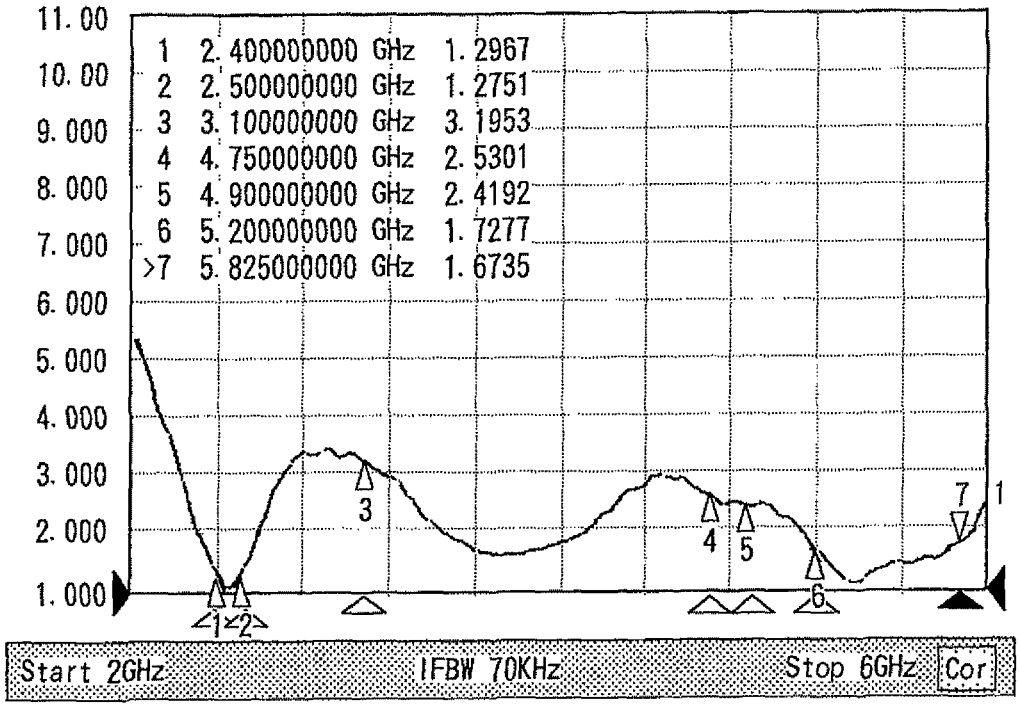
FIG. 28 are diagrams showing the characteristic of the wide band antenna in the implementation state shown in FIG. 27, in which part (a) is a VSWR characteristic diagram, and part (b) is a gain characteristic diagram.
Figure 28:
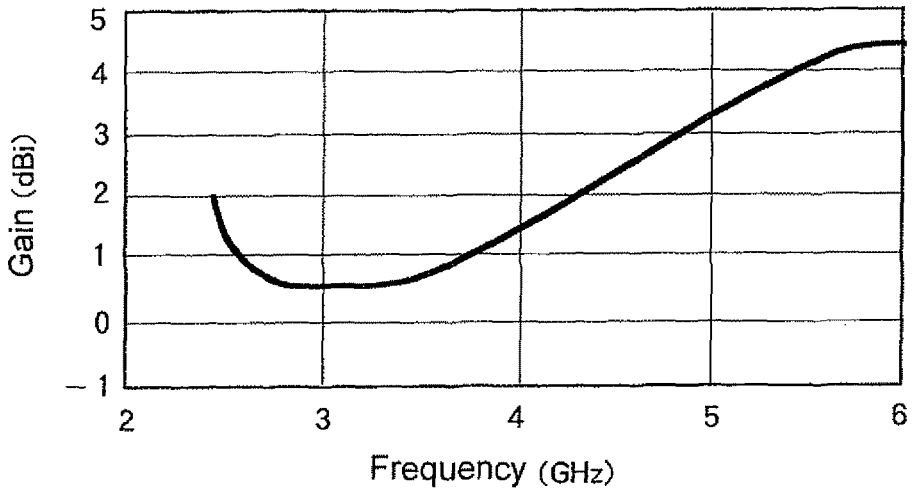

FIG. 28 show the VSWR characteristics and the gain characteristics of each of the wide band antennas 51 which are installed into the notebook personal computer as shown in FIG. 27.

As is apparent from FIG. 28(*a*), the VSWR obtained at the frequencies of 2.4 [GHz] and 3.1 [GHz] or higher, which is the use frequency band of the wide band antenna 51, has an excellent value of 3 or lower.

As is apparent from FIG. 28(*b*), the gain obtained at the frequencies of 2.4 [GHz] and 3.1 [GHz] or higher, which is the use frequency band of the wide band antenna 51, has an excellent value of 0.5 dBi or higher.

Note that the VSWR when the use frequency is 2.4 [GHz] is 1.2967, the VSWR when the use frequency is 3.1 [GHz] is 3.1953, and the VSWR when the use frequency is 5.2 [GHz] is 1.7277.

Figure 29:
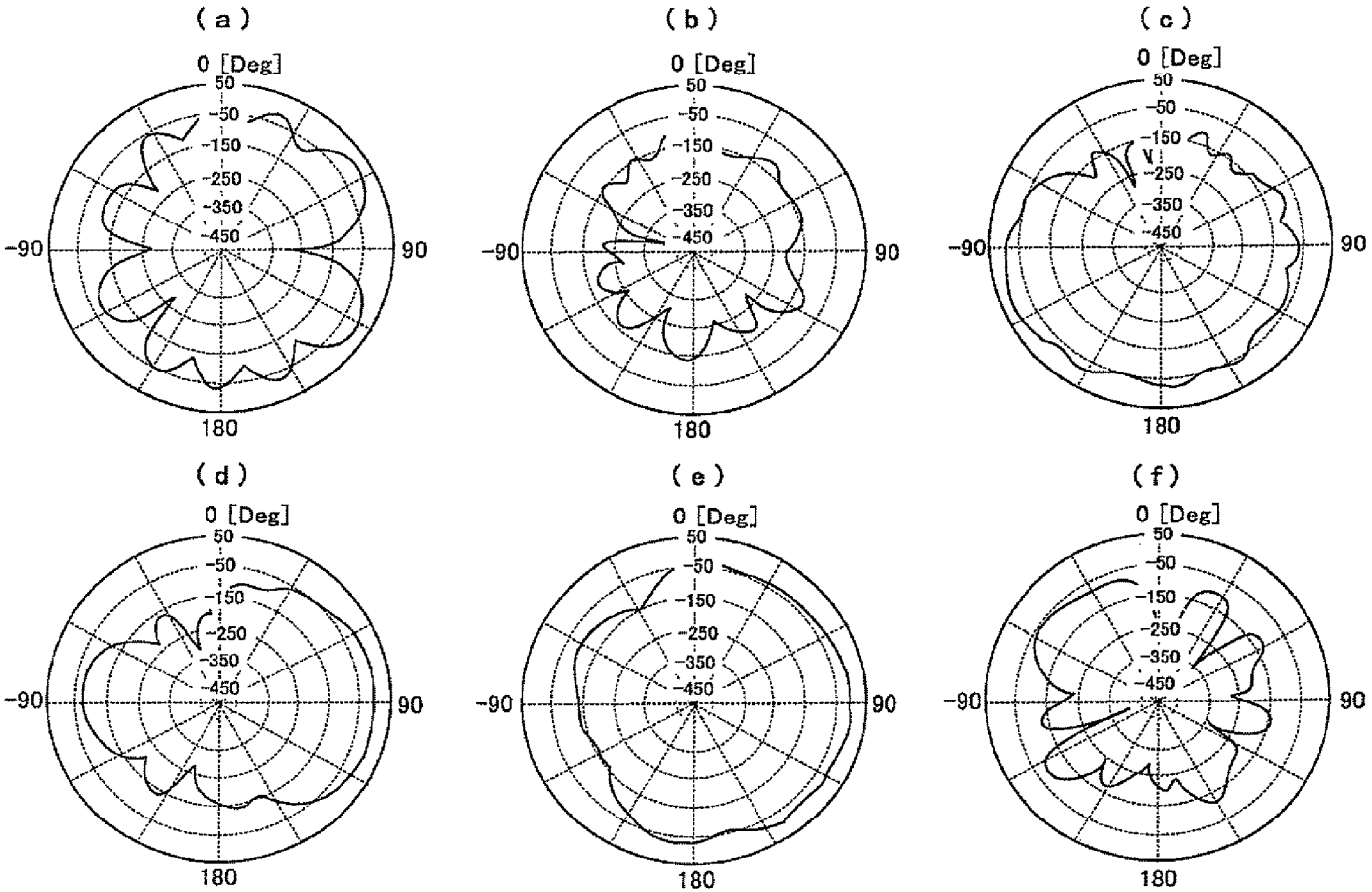
FIG. 29 are diagrams showing a directivity characteristic of the wide band antenna, in which part (a) is a directivity characteristic diagram of a horizontally polarized wave in a direction that is in parallel to a resin plate or a printed circuit board of the wide band antenna of the sizes shown in FIG. 21, part (b) is a directivity characteristic diagram of the horizontally polarized wave in a planar direction vertically orthogonal to the resin plate or the printed circuit board, part (c) is a directivity characteristic diagram of the horizontally polarized wave in the horizontal planar direction, part (d) is a directivity characteristic diagram of the vertically polarized wave in a direction that is in parallel to the resin plate or the printed circuit board, part (e) is a directivity characteristic diagram of the vertically polarized wave in a planar direction that is vertically orthogonal to the resin plate or the printed circuit board, and part (f) is a directivity characteristic diagram of the vertically polarized wave in a horizontal planar direction (2.45 [GHz]).
Figure 30:
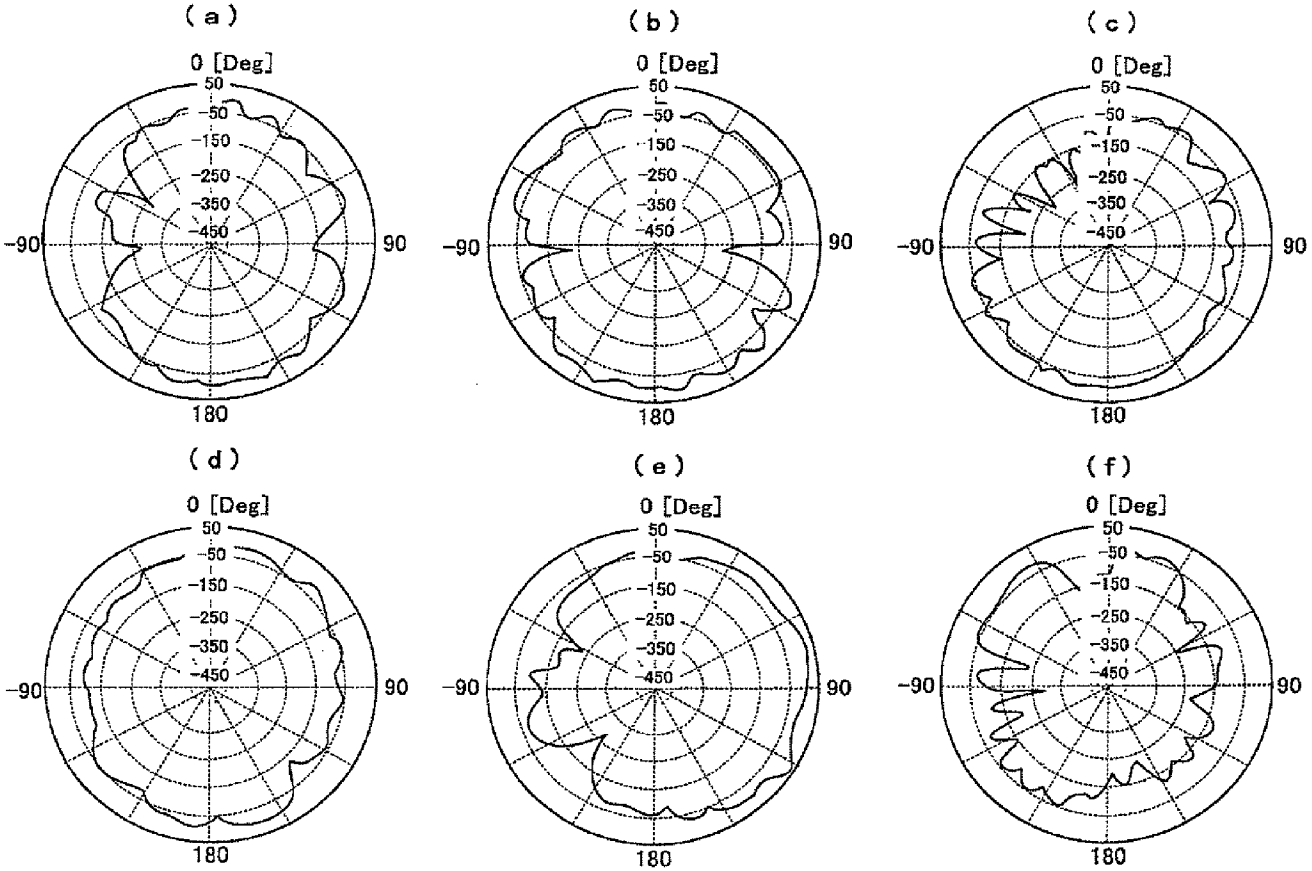
FIG. 30 are diagrams showing a directivity characteristic of the wide band antenna, in which part (a) is a directivity characteristic diagram of a horizontally polarized wave in a direction that is in parallel to a resin plate or a printed circuit board of the wide band antenna of the sizes shown in FIG. 21, part (b) is a directivity characteristic diagram of the horizontally polarized wave in a planar direction that is vertically orthogonal to the resin plate or the printed circuit board, part (c) is a directivity characteristic diagram of the horizontally polarized wave in the horizontal planar direction, part (d) is a directivity characteristic diagram of the vertically polarized wave in a direction that is in parallel to the resin plate or the printed circuit board, FIG. 30(*e*) is a directivity characteristic diagram of the vertically polarized wave in a planar direction that is vertically orthogonal to the resin plate or the printed circuit board, and part (f) is a directivity characteristic diagram of the vertically polarized wave in a horizontal planar direction (4.00 [GHz]).
Figure 31:
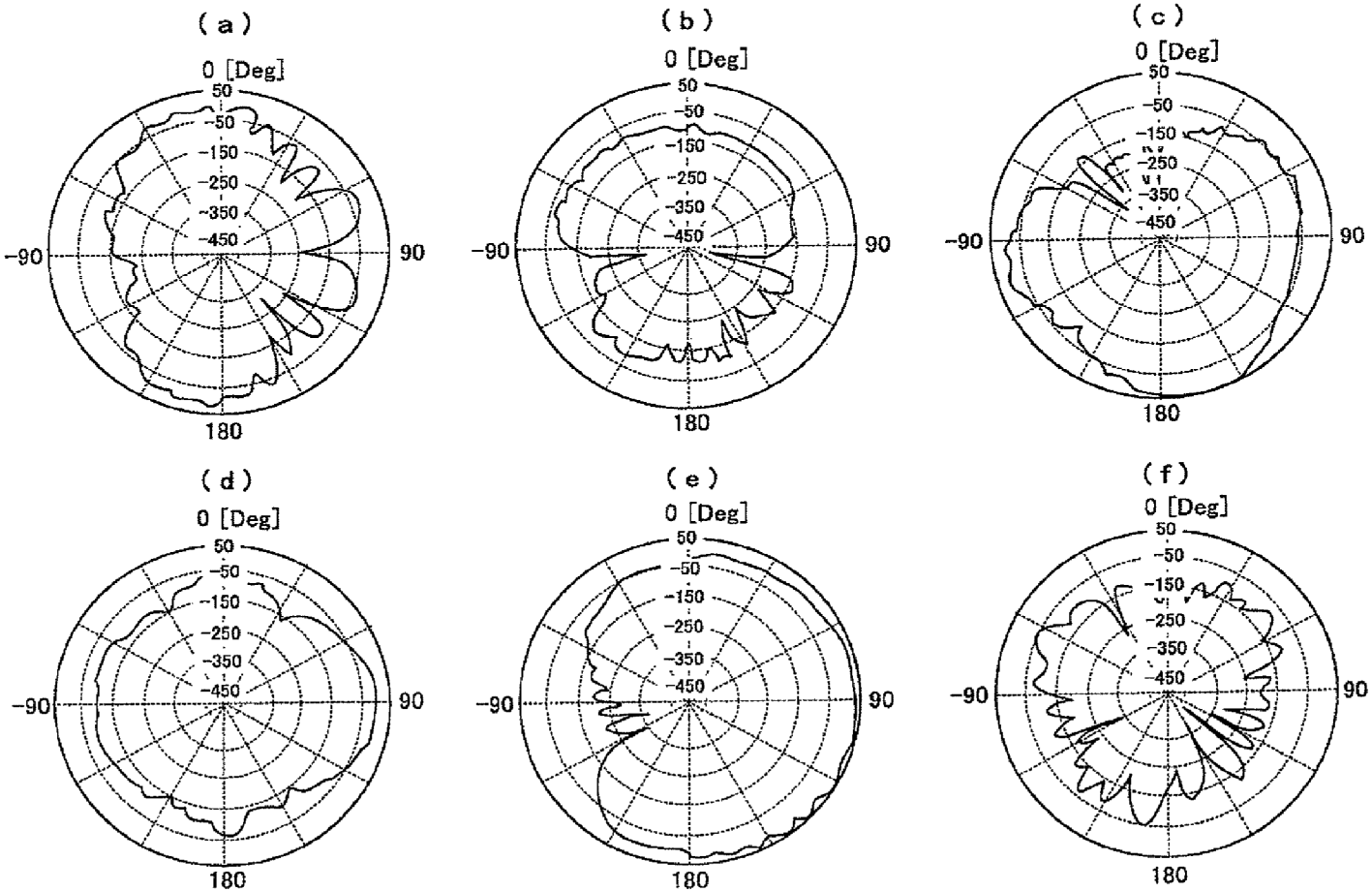
FIG. 31 are diagrams showing a directivity characteristic of the wide band antenna, in which part (a) is a directivity characteristic diagram of a horizontally polarized wave in a direction that is in parallel to a resin plate or a printed circuit board of the wide band antenna of the sizes shown in FIG. 21, part (b) is a directivity characteristic diagram of the horizontally polarized wave in a planar direction that is vertically orthogonal to the resin plate or the printed circuit board, part (c) is a directivity characteristic diagram of the horizontally polarized wave in the horizontal planar direction, part (d) is a directivity characteristic diagram of the vertically polarized wave in a direction that is in parallel to the resin plate or the printed circuit board, part (e) is a directivity characteristic diagram of the vertically polarized wave in a planar direction that is vertically orthogonal to the resin plate or the printed circuit board, and part (f) is a directivity characteristic diagram of the vertically polarized wave in a horizontal planar direction (5.2 [GHz]).

FIG. 29 show directivity characteristic diagrams when the resin plate or the printed circuit board on which the wide band antenna is formed is located perpendicularly to the horizontal plane within the personal computer, and the use frequency is set to 2.45 [GHz]. Part (a) shows the directivity characteristic of the horizontally polarized wave in a direction that is in parallel to the resin plate or the printed circuit board, part (b) is the directivity characteristic of the horizontally polarized wave in a planar direction that is vertically orthogonal to the resin plate or the printed circuit board, part (c) is the directivity characteristic of the horizontally polarized wave in a horizontal planar direction, part (d) is the directivity characteristic of the horizontally polarized wave in a direction that is in parallel to the resin plate or the printed circuit board, part (e) is the directivity characteristic of the vertically polarized wave in a planar direction that is vertically orthogonal to the resin plate or the printed circuit board, and part (f) is the directivity characteristic of the vertically polarized wave in the horizontal planar direction. Likewise, FIGS. 30(*a*), (*b*), (*c*), (*d*), (*e*), and (*f*) show the directivity characteristics in the respective directions when the use frequency is set to 4.00 [GHz], and FIGS. 31(*a*), (*b*), (*c*), (*d*), (*e*), and (*f*) show the directivity characteristics in the respective directions when the use frequency is set to 5.2 [GHz], respectively.

It is identified from those drawings that non-directivity is obtained over the wide frequency band.

In this way, it is identified that the wide band antenna 51 is an antenna having all of the downsizing, the wide band, the high efficiency, the low group delay time characteristic, and non-directivity.

As described above, according to this embodiment, it is possible to provide the wide band antenna that is available not only at the frequency band for the UWB communication, but also at the frequency band for the radio LAN. It is also possible to provide the wide band antenna in which the impedance matching characteristics and the electromagnetic radiation characteristics of the antenna are maintained or improved while the size of the antenna element is reduced.

Note that the wide band antenna 51 is hardly changed in performance even if the length and the width of the external ground conductor G30 are changed to any sizes. The above property is extremely important as the antenna that is incorporated into a mobile terminal which may be in a wide variety of configuration, structure, and size. Also, it means that the antenna structure has a large permissible range in designing and manufacturing the antenna, which is suitable for mass-production. In fact, when the wide band antenna is manufactured, there occurs a variation due to the machining error, the mismatching (particularly liable to occur due to millimeter waves) of the feeder coaxial connector and the cable, the installation error of the feeder terminal, the loss of the antenna material (loss of the joint material), or the measurement error. However, according to the structure of the wide band antenna of this embodiment, substantially the same characteristics as the simulation results are obtained regardless of a slight variation in the design and manufacture. That is, the basic portion such as the downsizing, the high efficiency, and the ultra wide band property are maintained.

It is presumed that the above facts are based on factors that the antenna element is so configured as to partially include the opening cross section structure of the double cylinder ridge waveguide, and both of the ridge element portion 52 and the ground portion 54*a* are substantially arc-configured.

The above properties of the wide band antenna according to this embodiment are remarkably proper for the radio LAN communication and the UWB communication whose intended use is expected to be dramatically enlarged in the future, particularly, the built-in antenna for the mobile terminal.

(Advantages of the Wide Band Antenna According to this Embodiment)

As described above, the features of the wide band antenna according to this embodiment reside in that the wide band antenna is the ultra wide band antenna having only the lowest available frequency on the basis of the operation mode of the double cylinder ridge waveguide, is suitable also for the radio LAN communication, has non-directivity, and is reduced in size by being provided with the erection element portion. The above characteristics are extremely important as the general purpose antenna for the radio LAN communication and the UWB communication whose intended purpose is expected to be dramatically expanded in the future. In particular, it is expected that the intended use thereof is further expanded by downsizing the wide band antenna.

It should be noted that the sizes, materials, and the like of the wide band antennas (antennas for radio LAN communication and UWB communication) described in this specification are merely examples and other implementation within a range of the feature of the present invention is included in a range of the present invention.

INDUSTRIAL APPLICABILITY

It is possible to use a wide band antenna according to the present invention as an antenna for UWB communications as well as an antenna for a mobile terminal, such as a portable telephone or a PDA, which is expected to use multiple frequencies but whose antenna installation portion is limited, a GPS antenna, a reception antenna for a terrestrial digital broadcasting system, a transmission/reception antenna for a radio LAN, a reception antenna for satellite digital broadcasting, an antenna for cellular phone, an antenna for ETC transmission/reception, a radio wave sensor, an antenna for a radio broadcasting receiver, and many other antennas. The maximum advantage of the wide band antenna according to the present invention resides in that it becomes possible to cope with those many applications using one antenna.

The invention claimed is:

1. A wide band antenna, comprising:

a ridge element for antenna characteristic adjustment corresponding to a ridge portion of a ridge waveguide and has a shape of a part or all of an opening cross section structure of the ridge waveguide;

the opening cross section structure of the ridge waveguide has a pair of ridge portions whose leading ends face each other, the ridge element corresponds to one ridge portion of the ridge waveguide, and the wide band antenna further comprising a ground portion corresponding to the other ridge portion of the ridge waveguide; and a radiation element for electromagnetic wave radiation, the ridge element has a planar shape and includes a feeder portion, and the radiation element extends from the ridge element.

2. The wide band antenna according to claim 1, further comprising: a capacitive coupling radiation element for electromagnetic wave radiation which is capacitively coupled with the radiation element or the ridge element, the radiation element is in a size that is used at a first frequency band, and the capacitive coupling radiation element is in a size that can be used at a second frequency band that is lower in the band than the first frequency band.

3. The wide band antenna according to claim 2, wherein the capacitive coupling radiation element is formed in a pattern same as that of the radiation element or in a symmetric pattern.

4. The wide band antenna according to claim 1, wherein the ridge element is connected with an erection element that erects from a plane including the ridge element.

5. The wide band antenna according to claim 1, wherein the ground portion has a structure in which a feeder wire that extends from the feeder portion is externally guided as a coplanar waveguide.

6. The wide band antenna according to claim 1, wherein the ground portion is coupled directly with an external ground conductor.

7. The wide band antenna according to claim 1, wherein at least one of the ridge element portion and the ground portion is formed in an arc configuration or a substantially arc configuration.

8. The wide band antenna according to claim 7, wherein the ridge element portion is of one base end structure which is obtained by cutting out the ridge portion of the ridge waveguide in the opening cross section structure in a height direction, and wherein the radiation element portion extends from the base end of the ridge element portion.

9. The wide band antenna according to claim 8, wherein the radiation element portion is formed in a meander configuration of the size capable of maintaining a group delay time to a given range at least in the use frequency band.

10. The wide band antenna according to claim 8, wherein the adjustment element portion for fine band adjustment is integrally formed with the ridge element portion.

11. The wide band antenna according to claim 7, wherein the ridge element portion is of a both base end structure that is symmetrical with respect to a portion where the height of the ridge portion of the ridge waveguide in the opening cross section structure is maximum as a center line, and wherein the radiation element portion extends from each of both base ends of the ridge element portion.

12. The wide band antenna according to claim 1, wherein a ground conductor pattern is integrally formed together with the wide band antenna on one printed circuit board.

13. A wide band antenna, comprising:

a ridge element for antenna characteristic adjustment corresponding to a ridge portion of a ridge waveguide and has a shape of a part or all of an opening cross section structure of the ridge waveguide; and a radiation element for electromagnetic wave radiation, the ridge element has a planar shape and includes a feeder portion, the ridge element is connected with an erection element that erects from a plane including the ridge element and the radiation element extends from the ridge element.

* * * * *